US006187501B1

(12) United States Patent
Aylward et al.

(10) Patent No.: US 6,187,501 B1
(45) Date of Patent: Feb. 13, 2001

(54) IMAGING MEMBER WITH TOUGH BINDER LAYER

(75) Inventors: Peter T. Aylward, Hilton; Robert P. Bourdelais, Pittsford; Thaddeus S. Gula, Rochester, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/370,955

(22) Filed: Aug. 10, 1999

(51) Int. Cl.[7] ..... G03C 1/79; G03C 1/795; G03C 1/93; G03C 1/765; G03C 8/52

(52) U.S. Cl. ..... 430/201; 430/531; 430/533; 430/534; 430/536; 430/538; 347/105; 503/227

(58) Field of Search ..... 430/531, 533, 430/534, 536, 538, 201; 347/105; 503/227

(56) References Cited

U.S. PATENT DOCUMENTS

| | | | | |
|---|---|---|---|---|
| 4,994,312 | | 2/1991 | Maier et al. | 428/36.5 |
| 5,466,519 | | 11/1995 | Shirakura et al. | 430/538 |
| 5,866,282 | | 2/1999 | Bourdelais | 430/536 |
| 5,888,714 | | 3/1999 | Bourdelais et al. | 430/536 |
| 5,998,119 | * | 12/1999 | Aylward et al. | 430/536 |
| 6,030,742 | * | 2/2000 | Bourdelais et al. | 430/536 |

FOREIGN PATENT DOCUMENTS

| | | |
|---|---|---|
| 6-27585 | 2/1994 | (JP) . |
| 8-15816 | 1/1996 | (JP) . |

OTHER PUBLICATIONS

Japanese Abstract 6–27585, Feb. 4, 1994.
Japanese Abstract 8–15816, Jan. 19, 1996.

* cited by examiner

*Primary Examiner*—Richard L. Schilling
(74) *Attorney, Agent, or Firm*—Paul A. Leipold

(57) ABSTRACT

The invention relates to an imaging member comprising a substrate, at least one oriented polymer sheet adhered to said substrate and a binder layer between said at least one oriented polymer sheet and said substrate, wherein said binder layer comprises a binder polymer that has an energy to break of between $9.0\times10^5$ J/m$^3$ and $3.5\times10^7$ J/m$^3$.

46 Claims, No Drawings

IMAGING MEMBER WITH TOUGH BINDER LAYER

FIELD OF THE INVENTION

This invention relates to imaging materials. In a preferred form it relates to imaging base materials with improved toughness.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult requiring great care and expense to ensure proper laydown and cooling of the polyethylene layers. The formation of a suitably smooth surface would also improve image quality as the display material would have more apparent blackness as the reflective properties of the improved base are more specular than the prior materials. As the whites are whiter and the blacks are blacker, there is more range in between and, therefore, contrast is enhanced. Layers of polyethylene while imparting waterproofness as well as a means to provide a white reflective base for added whiteness and image sharpness, adds very little to the overall durability of the base. It would be desirable if a more durable base was provided that is resistant to abrasions, scratches and was more resistant to tearing.

Prior art photographic reflective typically contain cellulose fiber paper to provide support for the imaging layers. While paper is an acceptable support for the imaging layers, providing a perceptually preferred feel and look to the photograph, paper is not very durable or tear resistant. It would be desirable to have a photographic base that has the look and feel of paper but has better durability.

In U.S. Pat. No. 5,888,714, Bourdelais et al., adhesive such as metallocene catalyzed ethylene plastomers are utilized to adhere biaxially oriented polymer sheets to a base material. While the melt extruded metallocene catalyzed ethylene plastomers are efficient in an melt extrusion process and create sufficient bond strength between the base material and the biaxially oriented polymers sheets, they are typically low in tear strength and therefore do not substantially increase the tear strength of a laminated support structure. In U.S. Pat. No. 5,888,714, Bourdelais et al, white pigments are added to the bonding layer to improve opacity, and image whiteness and sharpness. It is known that weight percent loading of white pigment beyond 24% causes problems such as extrusion die lines and melt curtain instability. It would be desirable to increase the weight percent loading of white pigments in the binder layer beyond 24%.

During the photographic processing of photographic images, photographic paper is typically punched and chopped as slit rolls of photographic paper are transformed into consumer images. It is known that reducing the energy to break for the bonding layer will improve the punching and chopping operations thereby improving the efficiency of photographic processing of images.

PROBLEM TO BE SOLVED BY THE INVENTION

There is a continuing need for imaging elements that are more durable and tear resistant to improve handling during the formation of images, and to improve consumer durability as images are viewed, stored, and shipped.

SUMMARY OF THE INVENTION

It is an object of the invention to overcome disadvantages of prior art and practices.

It is another object of the invention to provide a tear resistant imaging element.

It is another object to provide an imaging support with improved opacity and whiteness.

It is a further object to provide improved punching and chopping of imaging elements.

These and other objects of the invention are accomplished by an imaging member comprising a substrate, at least one oriented polymer sheet adhered to said substrate and a binder layer between said at least one oriented polymer sheet and said substrate, wherein said binder layer comprises a binder polymer that has an energy to break of between $9.0\times10^5$ J/m$^3$ and $3.5\times10^7$ J/m$^3$.

ADVANTAGEOUS EFFECT OF THE INVENTION

The invention provides a photographic element that is more durable and has improved toughness. The tough binder layers of this invention in combination with the very durable biaxially oriented sheets on each side of a paper base, provides a very tough print that has superior durability. The tough binder layers also improve image whiteness and opacity.

DETAILED DESCRIPTION OF THE INVENTION

The invention has numerous advantages over prior practices in the art. The imaging member of this invention has superior durability and toughness. Imaging members often are subjected to a variety of environmental stresses and adverse physical handling conditions that can cause damage to imaging elements. In large formats when an image is being slid into a frame, it is easy to kink or tear an image. Often when young children handling images, they can severely abuse a image by subjecting the image to shear forces which tend to tear an image. Once a image is torn, it loses value and is often discarded. In prior practices, the negative would have to be found and sent out for reprinting. Often the negatives can not easily be located for the specific print that has been damaged and even when it is found, it is very inconvenient and costly to take the negative back to the photofinisher to have a new image made. The tough binder layers of this invention in combination with the very durable biaxially oriented sheets on each side of a paper base, provides a very tough print that has superior durability over prior practices.

The tough binder layers also improve the whiteness and opacity of the image by using higher weight loading of white pigments. By improving image whiteness and opacity, the quality of the image is improved. Additionally, a tough binder layer is more efficient to punch, chop and convert thereby reducing the mechanical wear of knives and punches. Improving the punching and chopping of images increases the efficiency of photographic processing equipment. These and other advantages will be apparent from the detailed description below.

The layers of the biaxially oriented polymer sheet of this invention have levels of voiding, $TiO_2$ and colorants adjusted to provide optimum optical properties when combined with a low cost cellulose paper base. Biaxially oriented sheets are attached to both the top and bottom of a cellulose paper base. While paper is low in cost, it may be desirable to use a base substrate of polyester or other suitable material to further enhance toughness and overall durability. The biaxially oriented sheets utilized in this invention are required to be attached to the base substrate. The material used to adhere the biaxially oriented sheet to the base substrate is referred to as a binder layer. The binder layer preferably is a melt extruable polymer. To improve the toughness and tear resistance of the imaging support, it is preferable to use high yield strength polymers. In particular, polypropylene, polyester, polycarbonates and polyamides are preferred over polyethylene because they are tougher polymers and, when combined with biaxially oriented polymer sheets, provide an imaging member with superior strength and tear resistance. A laminated imaging element with a tough binder layer is more tear resistant and can endure more physical abuse than prior art ethylene-based binder layers.

An imaging member comprising a substrate, at least one oriented polymer sheet adhered to said substrate and a binder layer between said at least one oriented polymer sheet and said substrate, wherein said binder layer comprises a binder polymer that has an energy to break of between $9.0\times10^5$ J/m$^3$ and $3.5\times10^7$ J/m$^3$ is preferred because when the invention is subjected to a shearing force, it will provide more mechanical resistance. Polymers such as polyester, polypropylene, polycarbonates and even polyamides are preferred. These tough binder layer polymers in combination with biaxially oriented sheets provide excellent durability. Polyester is most preferred as the polyester polymer provides excellent tear resistance and has a low energy to break. The tough binder layer polymers may be applied as the sole binder polymer or as a blend. Typically blends may include polyester and polyolefin such as polyethylene, polypropylene or their copolymers. It may be desirable to adjust the blend ratio to improve the melt extrusion efficiency of the polymers. Further, by blending polyolefin polymers with the tough binder layer polymers, biaxially oriented polymer sheet to base adhesion is improved.

By increasing the weight percent of white pigments in the binder layer, the whiteness and opacity of the imaging element is improved. A weight percent loading of white pigment beyond 24% and up to 60% can be achieved without die lines and melt curtain instability problems that reduce the efficiency of a melt extrusion process.

The terms as used herein, "top", "upper", "imaging side", and "face" mean the side or toward the side of the polymer sheet in contact with biaxially oriented polymer sheet. The terms "bottom", "lower side", and "back" mean the side opposite or toward the side opposite to the side of the polymer sheet in contact with the biaxially oriented sheet or toward the side of the cellulose paper base. The terms used herein, "durability", "improved durability" and "tear proof" refer to improved tear resistance or tear strength of a support member. The term binder layer refers to a layer of adhesive like material that is used to attach a biaxially oriented polymer sheets to a base substrate.

Any suitable biaxially oriented polymer sheet may be used for the sheet on the top side of the laminated base of the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616; 4,758,462 and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density", is calculated as follows:

$$\frac{\text{Composite Sheet Density}}{\text{Polymer Density}} \times 100 = \%\text{ of Solid Density}$$

Percent solid density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 $\mu$m, preferably from 20 to 70 $\mu$m. Below 20 $\mu$m, the microvoided sheets may not be thick enough to minimize any inherent non-planarity in the support and would be more difficult to manufacture. At thicknesses higher than 70 $\mu$m, little improvement in either surface smoothness or mechanical properties is seen, and so there is little justification for the further increase in cost for extra materials.

The biaxially oriented sheets of the invention preferably have a water vapor permeability that is less than $1.55\times10^{-4}$ g/mm$^2$/day/atm. This allows faster emulsion hardening during formation, as the laminated invention support does not transmit water vapor from the emulsion layers during coating of the emulsions on the support. The transmission rate is measured by ASTM F1249.

"Void" is used herein to mean devoid of added solid and liquid matter, although it is likely the "voids" contain gas. The void-initiating particles which remain in the finished packaging sheet core should be from 0.1 to 10 microns in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar—C(R)=CH$_2$, wherein Ar represents an aromatic hydrocarbon radical, or an aromatic halohydrocarbon radical of the benzene series and R is hydrogen or the methyl radical; acrylate-type monomers include monomers of the formula $CH_2{=}C(R')—C(O)(OR)$ wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2{=}CH(O)COR$, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefin.

Suitable polyolefin materials include polypropylene, polyethylene, polymethylpentene, polystyrene, polybutylene and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tint is preferred.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a preferred top biaxially oriented sheet of the invention where the exposed surface layer is adjacent to the imaging layer is as follows:

| |
|---|
| Polyethylene exposed surface layer with blue tint and a fluoropolymer |
| Polypropylene layer containing 24% anatase $TiO_2$, optical brightener, antioxidant and Hindered amine light stabilizer (HALS) |
| Polypropylene microvoided layer with 0.60 grams per cubic cm density |
| Polypropylene layer with 8% rutile $TiO_2$ and HALS |
| Polyethylene bottom layer |

The sheet on the side of the base paper opposite to the emulsion layers may be any suitable sheet. The sheet may or may not be microvoided. It may have the same composition as the sheet on the top side of the paper backing material. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425.

The preferred biaxially oriented sheet is a biaxially oriented polyolefin sheet, most preferably a sheet of polyethylene or polypropylene. The thickness of the biaxially oriented sheet should be from 10 to 150 $\mu$m. Below 15 $\mu$m, the sheets may not be thick enough to minimize any inherent non-planarity in the support and would be more difficult to manufacture. At thicknesses higher than 70 $\mu$m, little improvement in either surface smoothness or mechanical properties are seen, and so there is little justification for the further increase in cost for extra materials.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of propylene and ethylene such as hexene, butene and octene are also useful. Polypropylenes are preferred because they are low in cost and have good strength and surface properties.

Suitable polyesters for the biaxially oriented sheets include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the backside of the laminated base can be made with layers of the same polymeric material, or it can be made with layers of different polymeric composition. For compatibility, an auxiliary layer can be used to promote adhesion of multiple layers.

Addenda may be added to the biaxially oriented backside sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching.

The biaxially oriented sheet on the back side of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

The structure of a preferred backside biaxially oriented sheet of this invention wherein the skin layer is on the bottom of the photographic element is as follows:

| |
|---|
| Solid polyester core |
| Mixture of polypropylenes and a terpolymer of ethylene-propylene-butylene |
| Styrene butadiene methacrylate coating with silica |

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephalate such as disclosed in U.S. Pat. Nos. 4,912,333; 4,994,312; and 5,055,371.

The preferred support is a photographic grade cellulose fiber paper. Extrusion laminating is carried out by bringing together the biaxially oriented sheets of the invention and the base paper with application of an binder layer between them followed by their being pressed in a nip such as between two rollers. The binder layer may be applied to either the biaxially oriented sheets or the base paper prior to their being brought into the nip. In a preferred form the binder layer is applied into the nip simultaneously with the biaxially oriented sheets and the base paper. The binder layer may be any suitable material that does not have a harmful effect upon the photographic element. A preferred imaging material comprises an imaging member comprising a substrate, at least one oriented polymer sheet adhered to said substrate and a binder layer between said at least one oriented polymer sheet and said substrate, wherein said binder layer comprises a binder polymer that has an energy to break of between $9.0\times10^5$ J/m$^3$ and $3.5\times10^7$ J/m$^3$. The binder polymer is melted at the time it is placed into the nip between the paper and the biaxially oriented sheet.

The energy to break for the binder polymers of this invention is defined as the area under a typical tensile stress strain curve where the stress strain curve has been extended to the breaking strength point. Energy to break is measured by running a simple tensile strength test for polymer binder at a rate of 4000% strain per min. The area under the curve is calculated by determining the area under the stress strain curve. The unit for energy to break are in J/m$^3$. A low energy to break for a polymer typically indicates a brittle polymer that fractures at relatively low force. A high energy to break polymer typically indicates a polymer that is ductile and is typified by large amounts of plastic deformation.

In order to provide additional toughness to the imaging element of the invention, polyethylene terephthalate is most preferred. The high breaking of a cast layer of polyester between the substrate and the biaxially oriented sheet adds additional tearing resistance and stiffness to the imaging element. When polyester binder layers used to laminate biaxially oriented polymers sheets to a imaging base materials it is desirable to use melt extrusion processing equipment that has been ceramic coated.

Extrusion grade polyester polymers are well known, widely used, and typically prepared from high molecular weight polyesters prepared by condensing a dihydric alcohol with a dibasic saturated fatty acid or derivative thereof. Suitable dihydric alcohols for use in preparing such polyesters are well known in the art and include any glycol wherein the hydroxyl groups are on the terminal carbon atom and contain from 2 to 12 carbon atoms such as, for example, ethylene glycol, propylene glycol, trimethylene glycol, hexamethylene glycol, decamethylene glycol, dodecamethylene glycol, 1,4-cyclohexane, dimethanol, and the like.

Suitable dibasic acids useful for the preparation of polyesters include those containing from 2 to 16 carbon atoms such as adipic acid, sebacic acid, isophthalic acid, terephtalic acid, and the like. Alkyl esters of acids, such as those listed above, can also be employed. Other alcohols and acids, as well as polyesters prepared therefrom and the preparation of the polyesters, are described in U.S. Pat. Nos. 2,720,503 and 2,901,466.

A binder polymer of polypropylene is preferred, as it also adds a higher degree of tearing resistance to the imaging element than prior art ethylene-based binder layers. Polypropylene, while not as tough as polyester, is better than polyethylene and is more cost effective than polyester. Extrusion coating either polyester or polypropylene in general is more difficult than polyethylene for edge stability and relative neckin of the melt curtain as the polymer exits the extrusion die.

The adhesion strength utilizing polypropylene, polyesters, or polyamides to imaging base materials tends to less than with polyethylene. In order to minimize these potential problems in may be desirable to extrude a blend of tougher binder polymer with a polyolefin such as polyethylene or an ethylene copolymer adhesive. The preferred embodiment comprises an imaging member comprising a substrate, at least one oriented polymer sheet adhered to said substrate and a binder layer between said at least one oriented polymer sheet and said substrate, wherein said binder layer comprises a binder polymer that has an energy to break of between $9.0\times10^5$ J/m$^3$ and $3.5\times10^7$ J/m$^3$ further comprises a blend of polyolefin. In a preferred embodiment said binder polymer comprises at least 10% polyolefin. The polyolefin provides improved stability to the melt curtain and further enhances the adhesion to the paper base and or biaxially oriented sheets while still providing improved toughness.

An additional means of providing a tough binder layer is to coextrude at least two or more layers. This means is preferred because some tough binder materials are difficult to extrude and may have adhesion problems to various substrates. To enable the extrusion these types of materials, a carrier layer of melt extrudable polymers that are more easily extruded may be used as the primary extruded material. By separately melting and pumping two or more polymers and then joining the dissimilar polymers in a feedblock prior to the extrusion die, the polymer melt streams form an integral layer of the two polymers that have separate and discrete properties. In this manner a more coatable polymer can be coated to support a less coatable material. For instance, an extrusion coatable grade of polyolefin or copolymer blend may serve as the primary carrier layer. There are also various copolyesters with aliphatic and aromatic functionality that may also be used to further enhance adhesion, as well as modified copolymer of ethylene. One example of a primary carrier is a blend of low density polyethylene with a melt index of 4.5 blended with an anhydride-modified ethylene acrylate between 10 and 90% to 90 and 10%. A preferred ratio is 80% low density polyethylene and 20% anhydride-modified ethylene acrylate that is compatible with polyester. Said layer is joined in a feedblock arrangement of a coextrusion process with an extrusion coatable copolyester. The copolyester may be adhered to a biaxially oriented polymer sheet such as polyester or polypropylene, while the blend of low density polyethylene and anhydride-modified ethylene acrylate is adhered to the substrate side. When the substrate is a plastic polymer such as polyester, polyamide or polyolefin, it may be desirable to have a three-layer coextruded tie layer where the copolyesters are outer skins that are more efficiently carried by a polyolefin carrier layer. Other examples of outer carrier layers may include a terpolymer of ethylene, butylene, and propylene or a copolyester blend with amorphous polyester, as well as blends of modified olefins such as a modifed ethylene acrylate. Additional material may include ethylene vinyl acetate, ethylene methylacrylate, polymethyl methacrylate, ethylene ethylacrylate, and ethylene methacrylic acid.

It may be desirable to incorporate antioxidants to stabilize the resin blends for thermal, light, and dark keeping. Typical examples may further include phenolic, phosphite, hindered amines light stabilizers, free radical scavengers, hydroxylamine, and lactone. These may be used as sole antioxidants or in any combination with each other to optimize the stability of the polymer. Additionally ultraviolet absorbing material may also be used to minimize the effects of this form of radiation on the polymer. In addition, slip agents such as fatty acids, fatty acids esters of glycerol, fatty acid amines and fatty alcohols and their dicarboxylic acid esters, oligomeric fatty acids esters, metallic soaps such as sodium, calcium and zinc sterates, polar and nonpolar polyethylene waxes, natural and synthetic waxes, fluoropolymers such as copolymer with vinylindene fluoride and polyetrafluoroethylene wax. The binder polymer may further comprises tinting agents, as well as fluorescent whiting agents. Typical fluorescent materials include bis-bezoxazole such as Hostalux, Uvitex, styrl-bis-benzoxazole, bis-(styryl) biphenyl, and pyrene-triazine, as well as benzotriazole-phenylcoumarin.

The binder layer comprises binder polymers that have and energy to break of between $9.0\times10^5$ J/m$^3$ and $3.5\times10^7$ J/m$^3$ wherein said binder layer comprises two or more integral layers of polymer. In this case, a primary carrier layer may be used to support a tougher polymer. The advantage of coextruding two or more layers is that it provides improved coatability and optimizes the positioning of the polymers adjacent to either the substrate or biaxially oriented sheet to enhance adhesion. This technique offers the ability to achieve improved toughness, while optimizing the imaging member for cost by utilizing lower cost material as part of the tough binder layer.

Another means to improve the adhesion of a biaxially oriented polymer sheet to a tough binder layer is to treat or modify the surface of the polymer sheet being attached to the tough binder layer. One means is to apply a surface treatment on the surface next to the tough binder layer with corona, plasma with controlled atmosphere of gases selected from the group consisting of: nitrogen, helium, oxygen, argon and other gases, flame and/or at least one subbing layer of hydrophilic materials. The plasma treatment may be at low or atmospheric pressure. Said treatment may be on the biaxially oriented polymer sheet and or the base substrate. The overall adhesion level may be further enhanced by the use of aqueous or solvent based primers that are coated or otherwise applied to the oriented polymer sheets and other to the base substrate. Such primers may be water dispersible polyester, polyolefins, acrylics, acrylate, or other polymers. At least one of the surfaces is coated with an adhesion promoting primer layer having a dry coverage of from 0.5 mg/m$^2$ to 1000 mg/m$^2$, wherein the primer comprises an interpolymer of a primary amine addition salt. A film forming binder which is an interpolymer of a primary amine addition salt with a peel strength of greater than 400 g is most desirable to assure good adhesion. The interpolymer of a primary amine addition salt comprises a structure according to formula I or II:

I

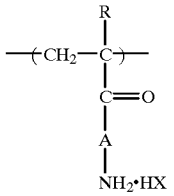

II

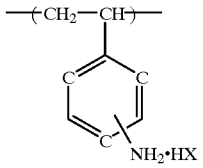

wherein

R is hydrogen or methyl;

A is —OR$^1$— or

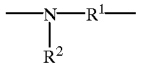

R$^1$ is a straight or branched chain alkylene group of 1 to 6 carbon atoms;

R$^2$ is hydrogen or a straight or branched alkyl or cycloalkyl group of 1 to 10 carbon atoms; and X is an acid anion.

The interpolymer further comprises vinyl monomers. The primer can be a water dispersible interpolymer or latex. More specifically, the interpolymers of the invention contain a polymerized vinyl monomer having a primary amine addition salt component that has the structure

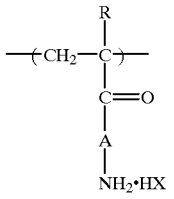

and/or a polymerized vinyl monomer containing an aminostyrene addition salt component that has the structure

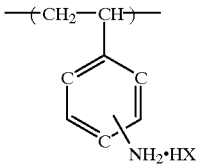

wherein

R is hydrogen or methyl;

A is either —$OR^1$— or

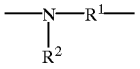

$R^1$ is a straight or branched chain alkylene group of 1 to 6 carbon atoms;

$R^2$ is hydrogen or a straight or branched alkyl or cycloalkyl group of 1 to 10 carbon atoms;

X is an acid anion.

Specific examples of useful monomers having the primary amine addition salt component include 2-aminoethyl methacrylate hydrochloride, 2-aminoethyl methacrylate hydrochloride, N-(3-aminopropyl)methacrylamide hydrochloride, and p-aminostyrene hydrochloride. Of these, the most preferred monomers are 2-aminoethyl methacrylate hydrochloride and 2-aminoethyl methacrylate hydrochloride.

The interpolymer primer of the invention may contain other vinyl monomers in addition to the monomer having a primary amine addition salt component. These other vinyl monomers include acrylic and methacrylic acid esters, styrene and its derivatives, butadiene, vinyl and vinylidene halides, acrylonitrile and methacrylonitrile, acrylamides and methacrylamides, and others. In a preferred embodiment, the interpolymer contains a nonionic hydrophilic vinyl monomer and a hydrophobic vinyl monomer, in addition to the monomer having a primary amine addition salt. Useful nonionic hydrophilic monomers include 2-hydroxyethyl acrylate, 2-hydroxyethyl methacrylate, vinylimidazole, and vinyl pyrrolidone. Useful hydrophobic vinyl monomers include alkyl acrylates and alkyl methacrylates, and styrene.

The interpolymer primer of the invention preferably contains from about 2 to about 50 weight percent, preferably from about 2 to about 20 weight percent, of the monomer having the primary amine addition salt component.

Use of adhesion promoting primers on polypropylene has been described in U.S. Pat. No. 4,214,039. The patent teaches a polypropylene thermoplastic film having a vinylidene chloride based topcoat layer which is applied to improve the physical properties of the thermoplastic film. The vinylidene chloride based topcoat is anchored to the film by a primer coating comprising the reaction product of a liquid epoxy resin and a water soluble acidified aminoethylated vinyl polymer. The primer coating also includes an amine curing catalyst. The primer coating of the present invention provides excellent adhesion to polyolefin coated photographic paper without the need for inclusion of an epoxy resin or curing catalyst. The interpolymer may also comprise from about 2 to about 50 weight percent of the primary amine addition salt component. Said layer further may comprises colorants, cross-linking agents, surfactants, coating aids, defoamers, thickeners, coalescing aids, matte beads, lubricants, or pH adjusting agents.

As has been mentioned, adhesion of the tie layer to polypropylene, polyesters, polyamides, and other oriented polymer sheets can be difficult. An additional means to achieve improved adhesion in an oriented sheet is during the formation and coextrusion of said sheet to incorporate an adhesion promoting layer. An example is to make the bottommost layer of the oriented sheet that is adjacent to the tough binder layer a copolymer or polymer blend that enhances the adhesion to the binder layer. This may include a terpolymer of ethylene, butylene, and propylene or a copolyester blend with amorphous polyester, as well as blends of modified olefins such as a modifed ethylene acrylate. Additional material may include ethylene vinyl acetate, ethylene methylacrylate, polymethyl methacrylate, ethylene ethylacrylate, and ethylene methacrylic acid.

In imaging it is important to have members that have a high amount of reflectivity and opacity. Improved reflectivity and opacity are achieved with the use of white pigments such as $TiO_2$, $CaCO_3$, talcs, clay, $BaSO_4$, kaloin, ZnO, and others. One advantage of using a tough binder polymer such as polyester is that the amount of pigment and, in particular, $TiO_2$ that may be compounded is higher than what can be compounded in polyethylene. It has been found that weight percent loadings of up to 60% white pigment are possible without a significant loss in melt extrusion efficiency. This provides an added dimension of increasing the opacity or sharpness of the imaging element. The use of a binder polymer comprising white pigment in an imaging member of this invention provides enhanced sharpness and opacity. Higher levels of sharpness are desirable to make imaging prints visually more attractive to the consumer. The improved opacity allows the use of higher density indicia on the backside of prints. The higher levels are usefully in providing a distinctive back print for imaging prints.

In a preferred embodiment said binder polymer comprising a white pigment further comprises a hindered amine light stabilizer. When polymers, particularly polyolefins, comprise a white pigment, it is important to add antioxidant to provide both photostability, as well as thermal stability. In another embodiment of this invention, said integrally formed biaxially oriented sheet further comprises a hindered amine light stabilizer (HALS). The hindered amine will have sufficient molar mass to minimize migration in the final product, will be miscible with polyester at the preferred concentrations, and will not impart color to the final product. In the preferred embodiment, examples of HALS include poly[[6-[(1,1,3,3-tetramethylbutyl)amino]-1,3,5-triazine-2,4-diyl][(2,2,6,6-tetramethyl-4-piperidinyl)imino]-1,6-hexanediyl[(2,2,6,6-tetramethyl-4-piperidinyl)imino]] (such as Chimassorb 944 LD/FL), 1,3,5-triazine-2,4,6-triamine, N,N'"-1,2-ethanediylbis[N-[3-[[4,6-bis[butyl(1,2,2,6,6-pentamethyl-4-piperidinyl)amino]-1,3,5-triazin-2-yl]methylamino]propyl]-N',N"-dibutyl-N', N"-bis(1,2,2,6,6-pentamethyl-4-piperidinyl)—(such as Chimassorb 119), and propanedioic acid, [[3,5-bis(1,1-dimethylethyl)-4-hydroxyphenyl]methyl]butyl-, bis(1,2,2,6,6-pentamethyl-4-piperidinyl)ester (such as Tinuvin 144), although they are not limited to these compounds. In the case of said imaging member comprising a base paper having adhered to its upper surface an integrally formed biaxially oriented polymer sheet comprising at least three layers, wherein said integrally formed biaxially oriented polymer sheet comprises at least one layer of voided polymer and above said voided layer an upper solid polymer layer and below said voided polymer layer a lower solid polymer layer, and at least one backside oriented polymer sheet below said base paper, and wherein said upper polymer layer comprises a white pigment and wherein at least one layer may comprises polyolefin and in particular polypropylene further comprising a white pigment such as $TiO_2$, the layer may contain any of the hindered phenol primary antioxidants commonly used for thermal stabilization of polypropylene, alone or in combination with, secondary antioxidants.

Examples of suitable hindered phenol primary antioxidants include benzenepropanoic acid, 3,5-bis(1,1-dimethylethyl)-4-hydroxy-, 2,2-bis[[3-[3,5-bis(1,1-dimethylethyl)-4-hydroxyphenyl]-1-oxopropoxy]methyl]-1,3-propanediyl ester (such as Irganox 1010), benzenepropanoic acid, 3,5-bis(1,1 -dimethylethyl)-4-hydroxy-, octadecyl ester (such as Irganox 1076), (such as Irganox 1035), phenol, 4,4',4"-[(2,4,6-trimethyl-1,3,5-benzenetriyl)tris(methylene)]tris[2,6-bis(1,1-dimethylethyl)—(such as Irganox 1330), but are not limited to these examples. Secondary antioxidants include organic alkyl and aryl phosphites including examples such as Phosphorous acid, bis[2,4-bis(1,1-dimethylethyl)-6-methylphenyl]ethyl ester (such as Irgafos 38), ethanamine, 2-[[2,4,8,10-tetrakis(1,1-dimethylethyl)dibenzo[d,f][1,3,2]dioxaphosphepin-6-yl]oxy]-N,N-bis[2-[[2,4,8,10-tetrakis(1,1-dimethylethyl)dibenzo[d,f][1,3,2]dioxaphosphepin-6-yl]oxy]ethyl] (such as Irgafos 12), phenol, 2,4-bis(1,1-dimethylethyl)-, phosphite (such as Irgafos 168). A preferred embodiment uses Irgafos 168. The combination of hindered amines with other primary and secondary antioxidants have a synergistic benefit in a multilayer biaxially oriented polymer sheet by providing thermal stability to polymers such as polypropylene during melt processing and extrusion and further enhancing their light and dark keeping properties which is not evident in a mono layer system for imaging products such as photographs. These unexpected results provide for a broader range of polymers that can be utilized in imaging product, thus enabling enhanced features to be incorporated into their design.

In the field of photosensitive products, there is always ongoing concerns with static and static discharge. The problem of controlling static charge is well known in the field of photography. The accumulation of charge on film or paper surfaces leads to the attraction of dirt, which can produce physical defects. The discharge of accumulated charge during or after the application of the sensitized emulsion layer(s) can produce irregular fog patterns or "static marks" in the emulsion. The static problems have been aggravated by increase in the sensitivity of new emulsions, increase in coating machine speeds, and increase in post-coating drying efficiency. The charge generated during the coating process may accumulate during winding and unwinding operations, during transport through the coating machines and during finishing operations such as slitting and spooling.

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during processing, resulting in a loss of antistatic function. The conductivity of antistatic layers employing an electronic conductor depends on electronic mobility rather than ionic mobility and is independent of humidity. Antistatic layers which contain conjugated polymers, semiconductive metal halide salts, semiconductive metal oxide particles, etc., have been described previously. However, these antistatic layers typically contain a high volume percentage of electronically conducting materials which are often expensive and impart unfavorable physical characteristics, such as color, increased brittleness, and poor adhesion to the antistatic layer.

Besides antistatic properties, an auxiliary layer in a photographic element may be required to fulfill additional criteria depending on the application. For example, for resin-coated photographic paper, the antistatic layer if present as an external backing layer should be able to receive prints (e.g., bar codes or other indicia containing useful information) typically administered by dot matrix printers and to retain these prints or markings as the paper undergoes processing. Most colloidal silica based antistatic backings without a polymeric binder provide poor post-processing back mark retention qualities for photographic paper. Typical antistat used in this application include a conductive agent comprises alkali metal salts of polyacids or cellulose derivatives. Other conductive agent comprises polymerized alkylene oxides and alkali metal salts.

In the formation of imaging members where it is desirable to have added toughness, the use of a tough binder layer may provide additional latitude wherein said oriented polymer sheet has a Young's modulus of less 3500 MPa. The imaging member comprising a substrate, at least one oriented polymer sheet adhered to said substrate and a binder layer between said at least one oriented polymer sheet and said substrate, wherein said binder layer comprises a binder polymer that has an energy to break of between $9.0\times10^5$ J/m$^3$ and $3.5\times10^7$ J/m$^3$ wherein said oriented polymer sheet comprises a biaxially oriented polyolefin or polyester sheet. By using a tough binder polymer, less expensive biaxially oriented sheets may be used while still obtaining the desirable degree of toughness. Said biaxially oriented polymer sheet may also comprise at least one layer of voids. When voids are integrated, they provide improved opacity without the use of expensive white pigments. Voids also help to improve the sharpness of imaging prints. In a preferred embodiment voids are used in combination with other layers comprising white pigment to provide high levels of opacity and image sharpness as well as a pleasing white appearance to the print material. In one preferred embodiment said binder polymer has a tensile modulus of between 1,500 to 3,300 MPa and a breaking strength of between 35 to 65 MPa. The embodiment of this invention may further comprise at least one layer comprising photosensitive silver halide. An additional embodiment comprises at least one layer comprising an ink jet or thermal dye receiving layer.

When imaging members are formed, there are often requirements to have the material feel like paper or in some case have exceptional tear resistance. When a paper like feel is needed and there is a further need to keep the overall cost of the material low, it is desirable to an imaging member comprising a substrate, at least one oriented polymer sheet adhered to said substrate and a binder layer between said at least one oriented polymer sheet and said substrate, wherein said binder layer comprises a binder polymer that has an energy to break of between $9.0\times10^5$ J/m$^3$ and $3.5\times10^7$ J/m$^3$ and wherein said substrate comprises cellulose fiber paper. In an area where exceptional tear resistance is need said substrate comprises a polyester sheet or a voided polyester sheet. The voided polyester sheet may be fully voided or may comprise a substrate or at least two layers wherein at least on layer comprises voids. It may be desirable to reduce the cost of some of these imaging member and in that case a combination of polyester and polyolefin may used.

In a composite imaging member in which a substrate is laminated with an oriented polymer sheet on each side using a melt extrudable polymer, the overall strength and physical durability is a finction of the individual layers. By using tough melt extrudable layers to adhere the oriented polymer sheet to the base substrate, it is possible to tailor the imaging member by adjusting the strength of the substrate. An imaging member comprising a substrate, at least one oriented polymer sheet adhered to said substrate and a binder layer between said at least one oriented polymer sheet and said substrate, wherein said binder layer comprises a binder polymer that has a an energy to break of between $9.0\times10^5$ J/m$^3$ and $3.5\times10^7$ J/m$^3$ may be adjusted in overall strength wherein said substrate has a Young's modulus of less than 18,000 MPa. In this manner the strength of the various components may be adjusted to balance the cost and strength of the imaging member. In said imaging member, the imaging member has a Young's modulus of between 2,000 MPa and 30,000 MPa. The imaging member of this invention has a tear strength of between 800 and 24,000 N.

The structure of a preferred support of the invention where the exposed surface layer is adjacent to the imaging layer is as follows:

| |
|---|
| Polyethylene exposed surface layer with blue tint and a fluoropolymer |
| Polypropylene layer containing 24% anatase $TiO_2$, optical brightener, antioxidant and Hindered amine light stabilizer (HALS) |
| Polypropylene microvoided layer with 0.60 grams per cubic cm density |
| Polypropylene layer with 8% rutile $TiO_2$ and HALS |
| Polyethylene bottom layer |
| 80% polyester and 20% ethylene coplymer with 36% rutile $TiO_2$ |
| Cellulose paper base |
| 80% polyester and 20% ethylene copolymer |
| Solid polypropylene core |
| Mixture of polypropylenes and a terpolymer of ethylene-propylene-butylene |
| Styrene butadiene methacrylate coating |

During the lamination process, it is desirable to maintain control of the tension of the biaxially oriented sheet(s) in order to minimize curl in the resulting laminated support. For high humidity applications (>50% RH) and low humidity applications (<20% RH), it is desirable to laminate both a front side and back side film to keep curl to a minimum.

In one preferred embodiment, in order to produce imaging elements with a desirable look and feel, it is preferable to use relatively thick paper supports (e.g., at least 120 mm thick, preferably from 120 to 250 mm thick) and relatively thin microvoided composite sheets (e.g., less than 50 mm thick, preferably from 20 to 50 mm thick, more preferably from 30 to 50 mm thick). The imaging member of this invention has an oriented polymer sheet adhered to both sides. In order to provide the optimal flexible in providing varying degrees of durability a preferred embodiment of this invention is to use only one tough binder layer with an energy to break of between $9.0\times10^5$ J/m$^3$and $3.5\times10^7$ J/m$^3$when said substrate has an oriented polymer sheet on both sides of said imaging member. The advantage of this is to provide a lower cost optimize member. In another embodiment of this invention a tough binder layer with an energy to break of between $9.0\times10^5$ J/m$^3$ and $3.5\times10^7$ J/m$^3$ is used to adhere a biaxially oriented sheet to both side of said substrate of said imaging member.

The preferred support is a photographic grade cellulose fiber paper. When using a cellulose fiber paper support, it is preferable to extrusion laminate the microvoided composite sheets to the base paper using a tough binder resin. Extrusion laminating is carried out by bringing together the biaxially oriented sheets of the invention and the base paper with application of an adhesive between them followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. Preferred materials are polyesters, copolyesters, polypropylenes or blends thereof that are melted at the time it is placed into the nip between the paper and the biaxially oriented sheet. It may also be desirable to coextrude at least two polymers simultaneously to optimize the adhesion to both the substrate and the biaxially oriented polymer sheet.

As used herein the phrase "imaging element" is a material that may be used as a imaging support for the transfer of images to the support by techniques, such as ink jet printing or thermal dye transfer, as well as a support for silver halide images. As used herein, the phrase "photographic element" is a material that utilizes photosensitive silver halide in the formation of images.

The thermal dye image-receiving layer of the imaging elements of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803; and 5,023,228.

As noted above, dye-donor elements are used to form a dye transfer image. Such a process comprises image-wise-heating a dye-donor element and transferring a dye image to a dye-receiving element as described above to form the dye transfer image.

In a preferred embodiment of the thermal dye transfer method of printing, a dye donor element is employed which compromises a poly-(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS0001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in detail in many books and publications. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photorecptors.

In one form of the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In one form of the electrophotographic process, a photosensitive element is permanently imaged to form areas of differential conductivity. Uniform electrostatic charging, followed by differential discharge of the imaged element, creates an electrostatic image. These elements are called electrographic or xeroprinting masters because they can be repeatedly charged and developed after a single imaging exposure.

In an alternate electrographic process, electrostatic images are created ionographically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent these toners form a film bonded to the paper. For heat-fusible toners, thermoplastic polymers are used as part of the particle. Heating both removes residual liquid and fixes the toner to paper.

The dye receiving layer or DRL for ink jet imaging may be applied by any known methods. Such as solvent coating, or melt extrusion coating techniques. The DRL is coated over the TL at a thickness ranging from 0.1–10 um, preferably 0.5–5 $\mu$m. There are many known formulations which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al., in U.S. Pat. Nos. 4,879,166; 5,104,730; 5,264,275; 5,104,730; 4,879,166; and Japanese Patents 1,095,091; 2,276,671; 2,276,670; 4,267,180; 5,024,335; and 5,016,517 discloses aqueous based DRL formulations comprising mixtures of psuedo-bohemite and certain water soluble resins. Light, in U.S. Pat. No. 4,903,040; 4,930,041; 5,084,338; 5,126,194; 5,126,195; 5,139,867; and 5,147,717 discloses aqueous-based DRL formulations comprising mixtures of vinyl pyrrolidone polymers and certain water-dispersible and/or water-soluble polyesters, along with other polymers and addenda. Butters et al., in U.S. Pat. Nos. 4,857,386 and 5,102,717, discloses ink-absorbent resin layers comprising mixtures of vinyl pyrrolidone polymers and acrylic or methacrylic polymers. Sato et al., in U.S. Pat. No. 5,194,317, and Higuma et al., in U.S. Pat. No. 5,059,983, discloses aqueous-coatable DRL formulations based on poly(vinyl alcohol). Iqbal, in U.S. Pat. No. 5,208,092, discloses water-based IRL formulations comprising vinyl copolymers which are subsequently cross-linked. In addition to these examples, there may be other known or contemplated DRL formulations which are consistent with the aforementioned primary and secondary requirements of the DRL, all of which fall under the spirit and scope of the current invention.

The preferred DRL is a 0.1–10 $\mu$m DRL which is coated as an aqueous dispersion of 5 parts alumoxane and 5 parts poly(vinyl pyrrolidone). The DRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers, and the like.

Although the ink-receiving elements as described above can be successfully used to achieve the objectives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118; 5,027,131; and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention.

This invention in one embodiment is directed to a silver halide photographic element capable of excellent performance when exposed by either an electronic printing method or a conventional optical printing method. An electronic printing method, such as with a laser printer, comprises subjecting a radiation sensitive silver halide emulsion layer of a recording element to actinic radiation of at least $10^{-4}$ ergs/cm$^2$ for up to 100$\mu$ seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above.

This invention in a preferred embodiment utilizes a radiation-sensitive emulsion comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula $$[ML_6]^n \quad \text{(I)}$$

wherein n is zero, −1, −2, −3 or −4; M is a filled frontier orbital polyvalent metal ion, other than iridium; and $L_6$ represents bridging ligands which can be independently selected, provided that least four of the ligands are anionic ligands, and at least one of the ligands is a cyano ligand or a ligand more electronegative than a cyano ligand; and (ii) an iridium coordination complex containing a thiazole or substituted thiazole ligand.

This invention in preferred form is directed towards a photographic recording element comprising a support and at least one light sensitive silver halide emulsion layer comprising silver halide grains as described above.

It has been discovered quite surprisingly that the combination of dopants (i) and (ii) provides greater reduction in reciprocity law failure than can be achieved with either dopant alone. Further, unexpectedly, the combination of dopants (i) and (ii) achieve reductions in reciprocity law failure beyond the simple additive sum achieved when employing either dopant class by itself. It has not been reported or suggested prior to this invention that the combination of dopants (i) and (ii) provides greater reduction in reciprocity law failure, particularly for high intensity and short duration exposures. The combination of dopants (i) and (ii) further unexpectedly achieves high intensity reciprocity with iridium at relatively low levels, and both high and low intensity reciprocity improvements even while using conventional gelatino-peptizer (e.g., other than low methionine gelatino-peptizer).

In a preferred practical application, the advantages of the invention can be transformed into increased throughput of digital substantially artifact-free color print images while exposing each pixel sequentially in synchronism with the digital data from an image processor.

In one embodiment, the present invention represents an improvement on the electronic printing method. Specifically, this invention in one embodiment is directed to an electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode. The present invention realizes an improvement in reciprocity failure by selection of the radiation sensitive silver halide emulsion layer. While certain embodiments of the invention are specifically directed towards electronic printing, use of the emulsions and elements of the invention is not limited to such specific embodiment, and it is specifically contemplated that the emulsions and elements of the invention are also well suited for conventional optical printing.

It has been unexpectedly discovered that significantly improved reciprocity performance can be obtained for silver halide grains (a) containing greater than 50 mole percent chloride, based on silver, and (b) having greater than 50 percent of their surface area provided by {100} crystal faces by employing a hexacoordination complex dopant of class (i) in combination with an iridium complex dopant comprising a thiazole or substituted thiazole ligand. The reciprocity improvement is obtained for silver halide grains employing conventional gelatino-peptizer, unlike the contrast improvement described for the combination of dopants set forth in U.S. Pat. Nos. 5,783,373 and 5,783,378, which requires the use of low methionine gelatino-peptizers as discussed therein, and which states it is preferable to limit the concentration of any gelatino-peptizer with a methionine level of greater than 30 micromoles per gram to a concentration of less than 1 percent of the total peptizer employed. Accordingly, in specific embodiments of the invention, it is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention. In preferred embodiments of the invention, gelatino-peptizer is employed which comprises at least 50 weight percent of gelatin containing at least 30 micromoles of methionine per gram, as it is frequently desirable to limit the level of oxidized low methionine gelatin which may be used for cost and certain performance reasons.

In a specific, preferred form of the invention it is contemplated to employ a class (i) hexacoordination complex dopant satisfying the formula:

$$[ML_6]^n \quad (I)$$

where n is zero, −1, −2, −3 or −4;

M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt^{+4}$, more preferably an iron, ruthenium or osmium ion, and most preferably a ruthenium ion;

$L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of class (i) which include six cyano ligands are specifically preferred.

Illustrations of specifically contemplated class (i) hexacoordination complexes for inclusion in the high chloride grains are provided by Olm et al U.S. Pat. No. 5,503,970 and Daubendiek et al U.S. Pat. Nos. 5,494,789 and 5,503,971, and Keevert et al U.S. Pat. No. 4,945,035, as well as Murakami et al Japanese Patent Application Hei-2[1990]-249588, and *Research Disclosure* Item 36736. Useful neutral and anionic organic ligands for class (ii) dopant hexacoordination complexes are disclosed by Olm et al U.S. Pat. No. 5,360,712 and Kuromoto et al U.S. Pat. No. 5,462,849.

Class (i) dopant is preferably introduced into the high chloride grains after at least 50 (most preferably 75 and optimally 80) percent of the silver has been precipitated, but before precipitation of the central portion of the grains has been completed. Preferably class (i) dopant is introduced before 98 (most preferably 95 and optimally 90) percent of the silver has been precipitated. Stated in terms of the fully precipitated grain structure, class (i) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The class (i) dopant can be distributed throughout the interior shell region delimited above or can be added as one or more bands within the interior shell region.

Class (i) dopant can be employed in any conventional useful concentration. A preferred concentration range is from $10^{-8}$ to $10^{-3}$ mole per silver mole, most preferably from $10^{-6}$ to $5\times10^{-4}$ mole per silver mole.

The following are specific illustrations of class (i) dopants:

(i-1) $[Fe(CN)_6]^{-4}$
(i-2) $[Ru(CN)_6]^{-4}$
(i-3) $[Os(CN)_6]^{-4}$
(i-4) $[Rh(CN)_6]^{-3}$
(i-5) $[Co(CN)_6]^{-3}$
(i-6) $[Fe(pyrazine)(CN)_5]^{-4}$
(i-7) $[RuCl(CN)_5]^{-4}$
(i-8) $[OsBr(CN)_5]^{-4}$
(i-9) $[RhF(CN)_5]^{-3}$
(i-10) $[In(NCS)_6]^{-3}$
(i-11) $[FeCO(CN)_5]^{-3}$
(i-12) $[RuF_2(CN)_4]^{-4}$
(i-13) $[OsCl_2(CN)_4]^{-4}$
(i-14) $[RhI_2(CN)_4]^{-3}$
(i-15) $[Ga(NCS)_6]^{-3}$
(i-16) $[Ru(CN)_5(OCN)]^{-4}$
(i-17) $[Ru(CN)_5(N_3)]^{-4}$
(i-18) $[Os(CN)_5(SCN)]^{-4}$
(i-19) $[Rh(CN)_5(SeCN)]^{-3}$
(i-20) $[Os(CN)Cl_5]^{-4}$
(i-21) $[Fe(CN)_3Cl_3]^{-3}$
(i-22) $[Ru(CO)_2(CN)_4]^{-1}$ When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to class (ii) dopants, otherwise described below.

The class (ii) dopant is an iridium coordination complex containing at least one thiazole or substituted thiazole ligand. Careful scientific investigations have revealed Group VIII hexahalo coordination complexes to create deep electron traps, as illustrated R. S. Eachus, R. E. Graves and M. T. Olm *J. Chem. Phys.*, Vol. 69, pp. 4580–7 (1978) and *Physica Status Solidi* A, Vol. 57, 429–37 (1980) and R. S. Eachus and M. T. Olm *Annu. Rep. Prog Chem. Sect. C. Phys. Chem.*, Vol. 83, 3, pp. 3–48 (1986). The class (ii) dopants employed in the practice of this invention are believed to create such deep electron traps. The thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. The class (ii) dopant preferably is an iridium coordination complex having ligands each of which are more electropositive than a cyano ligand. In a specifically preferred form the remaining non-thiazole or non-substituted-thiazole ligands of the coordination complexes forming class (ii) dopants are halide ligands.

It is specifically contemplated to select class (ii) dopants from among the coordination complexes containing organic ligands disclosed by Olm et al U.S. Pat. No. 5,360,712, Olm et al U.S. Pat. No. 5,457,021 and Kuromoto et al U.S. Pat. No. 5,462,849.

In a preferred form it is contemplated to employ as a class (ii) dopant a hexacoordination complex satisfying the formula:

$$[IrL^1_6]^{n'} \quad (II)$$

wherein n' is zero, −1, −2, −3 or −4; and $L^1_6$ represents six bridging ligands which can be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Class (ii) dopant is preferably introduced into the high chloride grains after at least 50 (most preferably 85 and optimally 90) percent of the silver has been precipitated, but before precipitation of the central portion of the grains has been completed. Preferably class (ii) dopant is introduced before 99 (most preferably 97 and optimally 95) percent of the silver has been precipitated. Stated in terms of the fully precipitated grain structure, class (ii) dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole.

Specific illustrations of class (ii) dopants are the following:

(ii- 1) $[IrCl_5(thiazole)]^{-2}$ (ii-2) $[IrCl_4(thiazole)_2]^{-1}$ (ii-3) $[IrBr_5(thiazole)]^{-2}$ (ii-4) $[IrBr_4(thiazole)_2]^{-1}$ (ii-5) $[IrCl_5(5\text{-methylthiazole})]^{-2}$ (ii-6) $[IrCl_4(5\text{-methylthiazole})_2]^{-1}$ (ii-7) $[IrBr_5(5\text{-methylthiazole})]^{-2}$ (ii-8) $[IrBr_4(5\text{-methylthiazole})_2]^{-1}$ In one preferred aspect of the invention in a layer using a magenta dye forming coupler, a class (ii) dopant in combination with an $OsCl_5(NO)$ dopant has been found to produce a preferred result.

Emulsions demonstrating the advantages of the invention can be realized by modifying the precipitation of conventional high chloride silver halide grains having predominantly (>50%) {100} crystal faces by employing a combination of class (i) and (ii) dopants as described above.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) use of bromide is typically limited to less than 10 mole percent based on silver and iodide is limited to less than 1 mole percent based on silver.

In a widely used form high chloride grains are precipitated to form cubic grains—that is, grains having {100} major faces and edges of equal length. In practice ripening effects usually round the edges and comers of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 $\mu$m, preferably less than 0.2 $\mu$m, and optimally less than 0.07 $\mu$m. High chloride {100} tabular grain emulsions and their preparation are disclosed by Maskasky U.S. Pat. No. 5,264,337 and 5,292,632, House et al U.S. Pat. No. 5,320,938, Brust et al U.S. Pat. No. 5,314,798, and Chang et al U.S. Pat. No. 5,413,904.

Once high chloride grains having predominantly {100} crystal faces have been precipitated with a combination of class (i) and class (ii) dopants described above, chemical and spectral sensitization, followed by the addition of conventional addenda to adapt the emulsion for the imaging application of choice can take any convenient conventional form. These conventional features are illustrated by *Research Disclosure*, Item 38957, cited above, particularly:

III. Emulsion washing;

IV. Chemical sensitization;

V. Spectral sensitization and desensitization;

VII. Antifoggants and stabilizers;

VIII. Absorbing and scattering materials;

IX. Coating and physical property modifying addenda; and

X. Dye image formers and modifiers.

Some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with comer epitaxy are illustrated by Maskasky U.S. Pat. No. 5,275,930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

In the simplest contemplated form a recording element contemplated for use in the electronic printing method of one embodiment of the invention can consist of a single emulsion layer satisfying the emulsion description provided above coated on a conventional photographic support, such as those described in *Research Disclosure*, Item 38957, cited above, XVI. Supports. In one preferred form the support is a white reflective support, such as photographic paper support or a film support that contains or bears a coating of a reflective pigment. To permit a print image to be viewed using an illuminant placed behind the support, it is preferred to employ a white translucent support, such as a Duratrans™ or Duraclear™ support.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler —Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948.

Typical cyan couplers are represented by the following formulas:

CYAN-1

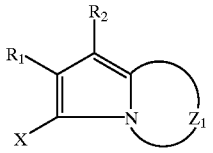

CYAN-2

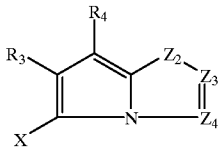

CYAN-3

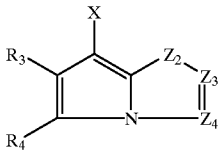

CYAN-4

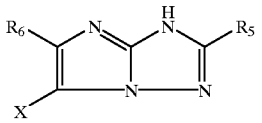

wherein $R_1$, $R_5$ and $R_8$ each represents a hydrogen or a substituent; $R_2$ represents a substituent; $R_3$, $R_4$ and $R_7$ each represents an electron attractive group having a Hammett's substituent constant σpara of 0.2 or more and the sum of the σpara values of $R_3$ and $R_4$ is 0.65 or more; $R_6$ represents an electron attractive group having a Hammett's substituent constant σpara of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)═ and —N═; and $Z_3$ and $Z_4$ each represents —C($R_8$)═ and —N═.

For purposes of this invention, an "NB coupler" is a dye-forming coupler which is capable of coupling with the developer 4-amino-3-methyl-N-ethyl-N-(2-methanesulfonamidoethyl)aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 mn, less than that of the same dye in a 3% solution (w/v) in acetonitrile.

In a preferred embodiment the cyan dye-forming "NB coupler" useful in the invention has the formula (IA)

(IA)

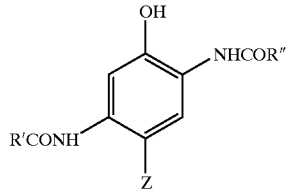

wherein

R' and R" are substituents selected such that the coupler is a "NB coupler", as herein defined; and Z is a hydrogen atom or a group which can be split off by the reaction of the coupler with an oxidized color developing agent.

The coupler of formula (IA) is a 2,5-diamido phenolic cyan coupler wherein the substituents R' and R" are preferably independently selected from unsubstituted or substituted alkyl, aryl, amino, alkoxy and heterocyclyl groups.

In a further preferred embodiment, the "NB coupler" has the formula (I):

(I)

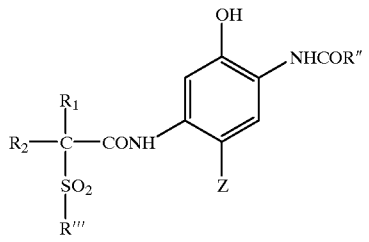

wherein

R" and R''' are independently selected from unsubstituted or substituted alkyl, aryl, amino, alkoxy and heterocyclyl groups and Z is as hereinbefore defined;

$R_1$ and $R_2$ are independently hydrogen or an unsubstituted or substituted alkyl group; and Typically, R" is an alkyl, amino or aryl group, suitably a phenyl group. R''' is desirably an alkyl or aryl group or a 5–10 membered heterocyclic ring which contains one or more heteroatoms selected from nitrogen, oxygen and sulfur, which ring group is unsubstituted or substituted.

In the preferred embodiment the coupler of formula (I) is a 2,5-diamido phenol in which the 5-amido moiety is an amide of a carboxylic acid which is substituted in the alpha position by a particular sulfone (—$SO_2$-) group, such as, for example, described in U.S. Pat. No. 5,686,235. The sulfone moiety is an unsubstituted or substituted alkylsulfone or a heterocyclyl sulfone or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima ($\lambda_{max}$) which are shifted hypsochromically and are generally in the range of 620–645 nm, which is ideally suited for producing excellent color reproduction and high color saturation in color photographic papers.

Referring to formula (I), $R_1$ and $R_2$ are independently hydrogen or an unsubstituted or substituted alkyl group, preferably having from 1 to 24 carbon atoms and in particular 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom and if only one of $R_1$ and $R_2$ is a hydrogen atom then the other is preferably an alkyl group having 1 to 4 carbon atoms, more preferably one to three carbon atoms and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl, having 3–8 carbon atoms and the tern 'aryl' includes specifically fused aryl.

In formula (I), R" is suitably an unsubstituted or substituted amino, alkyl or aryl group or a 5–10 membered he cyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, R" is a 4-chlorophenyl, 3,4-dichlorophenyl, 3,4-difluorophenyl, 4-cyanophenyl, 3-chloro-4-cyanophenyl, pentafluorophenyl, or a 3- or 4-sulfonamidophenyl group.

In formula (I), when R''' is alkyl it may be unsubstituted or substituted with a substituent such as halogen or alkoxy. When R''' is aryl or a heterocycle, it may be substituted. Desirably it is not substituted in the position alpha to the sulfonyl group.

In formula (I), when R''' is a phenyl group, it may be substituted in the meta and/or para positions with one to three substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxycarbonylamino and alkyl- or aryl-carbamoyl groups.

In particular each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form e.g. polyalkylene oxides.

In formula (I) or (IA) Z is a hydrogen atom or a group which can be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169, 3,227,551, 3,432,521, 3,467,563, 3,617,291, 3,880,661, 4,052,212, and 4,134,766; and in U.K. Patent Nos. and published applications 1,466,728, 1,531,927, 1,533,039, 2,066,755A, and 2,017,704A, the disclosures of which are incorporated herein by reference. Halogen, alkoxy and aryloxy groups are most suitable.

Examples of specific coupling-off groups are —Cl, —F, —Br, —SCN, $—OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

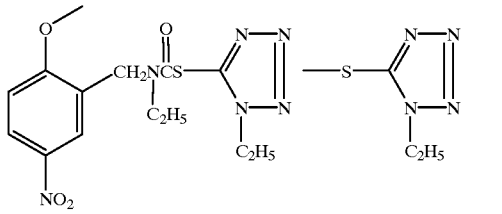

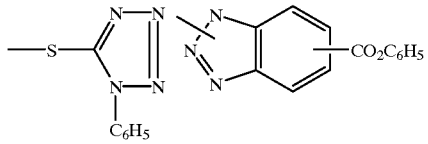

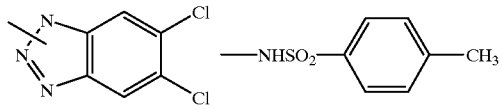

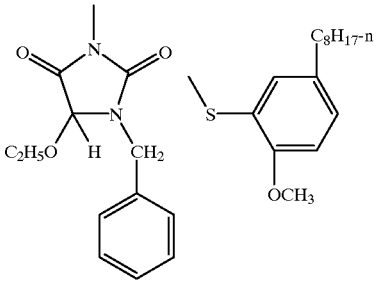

-continued

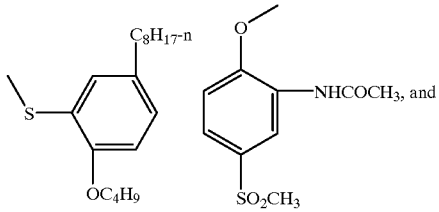

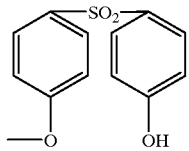

Typically, the coupling-off group is a chlorine atom, hydrogen atom or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group or hydrogen. Therefore, in these embodiments the ballast would be primarily located as part of the other groups. Furthermore, even if the coupling-off group Z contains a ballast it is often necessary to ballast the other substituents as well, since Z is eliminated from the molecule upon coupling; thus, the ballast is most advantageously provided as part of groups other than Z.

The following examples further illustrate preferred coupler of the invention. It is not to be construed that the present invention is limited to these examples.

IC-1

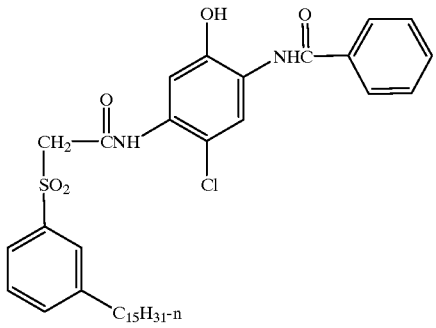

-continued
IC-2
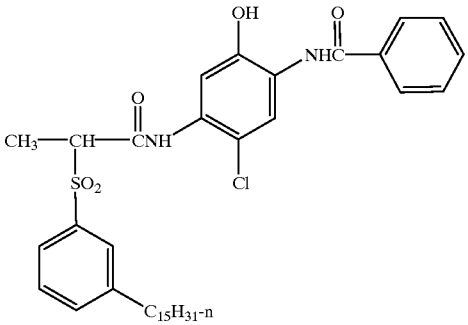
IC-3
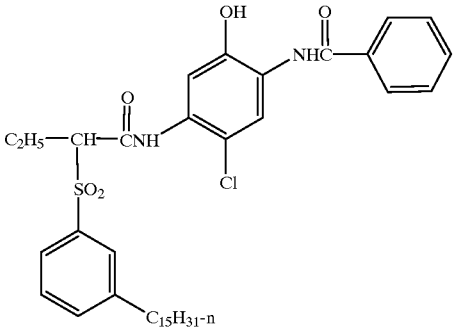
IC-4
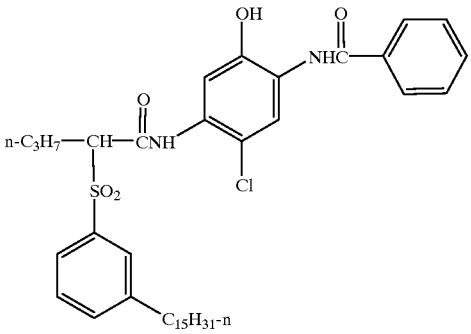
IC-5
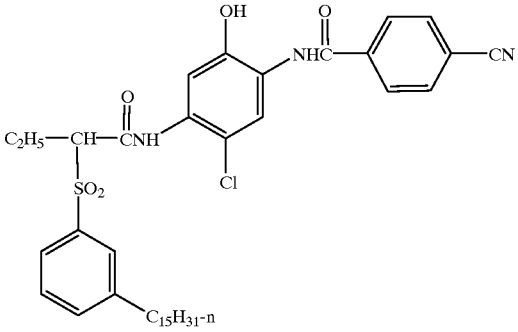
-continued
IC-6
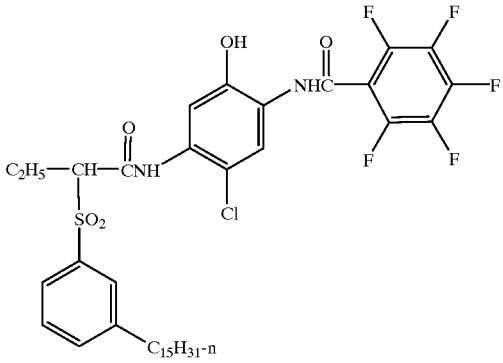
IC-7
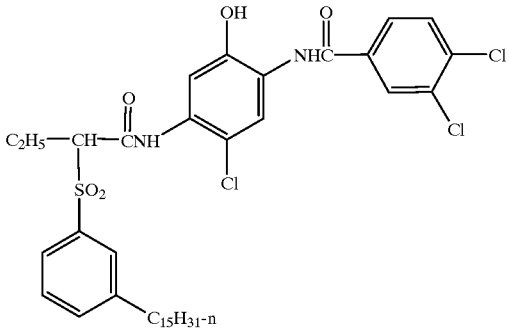
IC-8
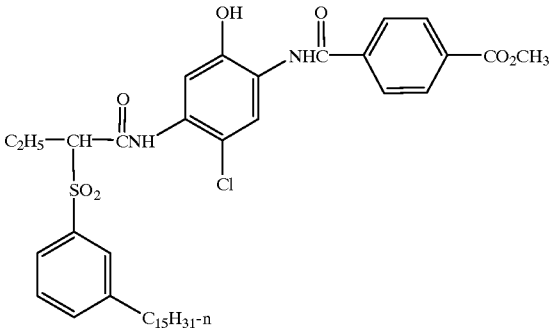
IC-9
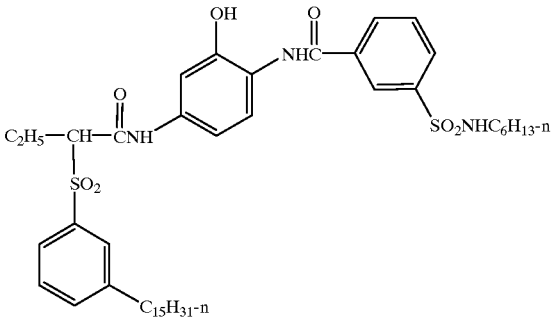

-continued
IC-10
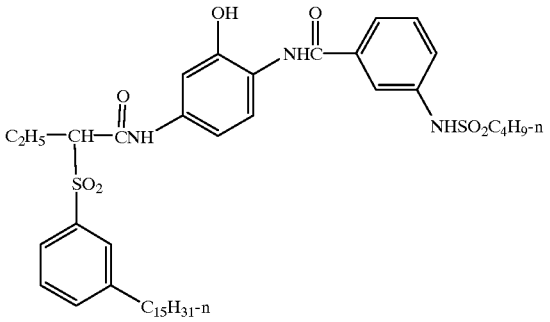
IC-11
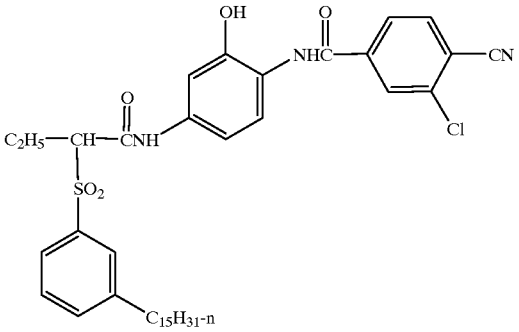
IC-12
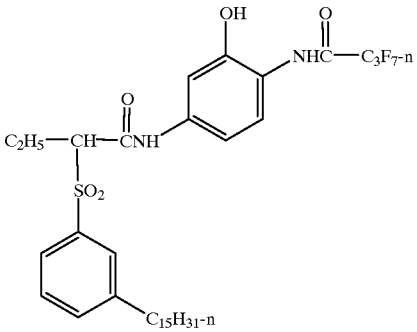
IC-13
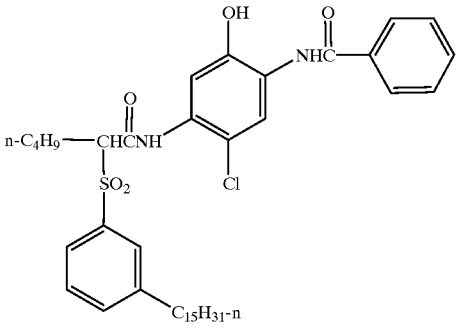
-continued
IC-14
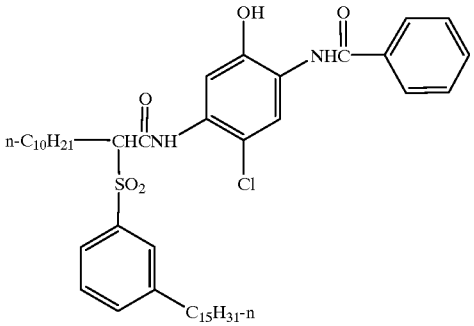
IC-15
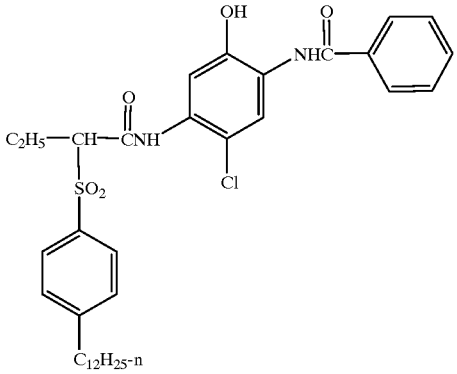
IC-16
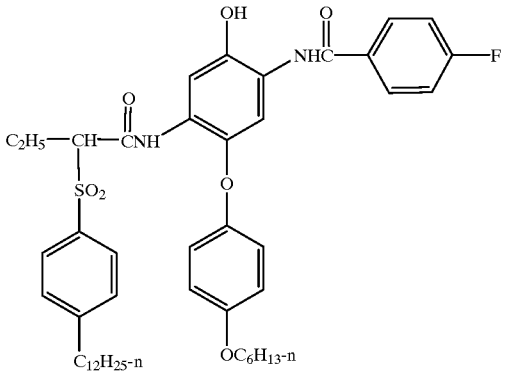
IC-17
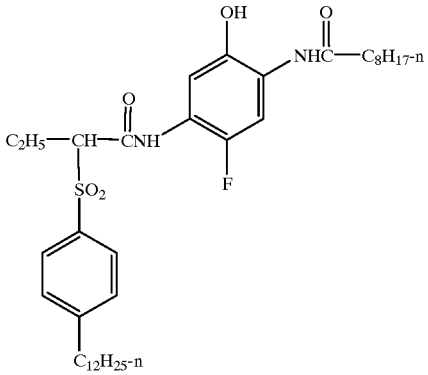

-continued
IC-18
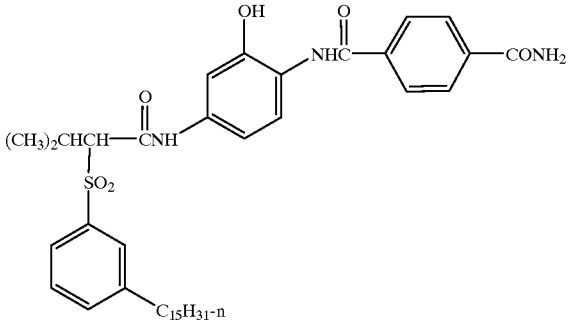
IC-19
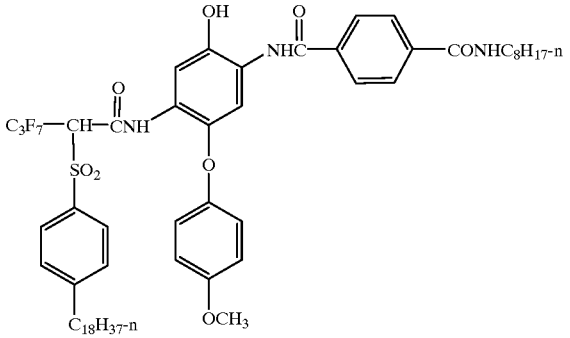
IC-20
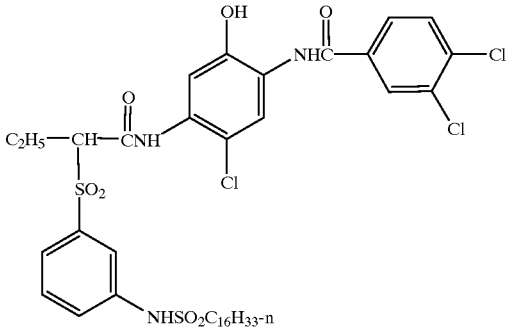
IC-21
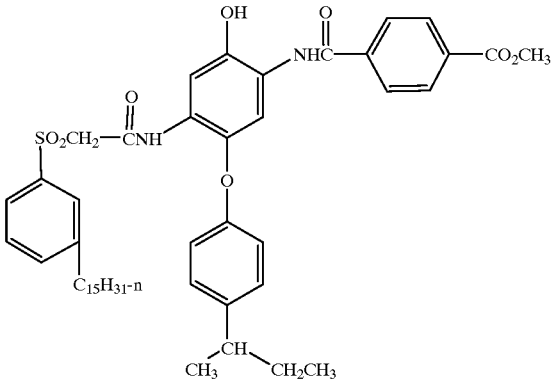
-continued
IC-22
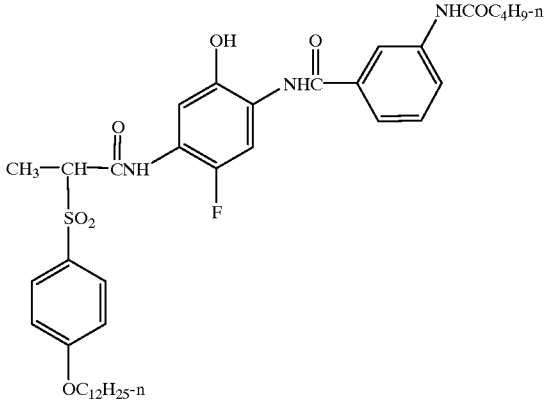
IC-23
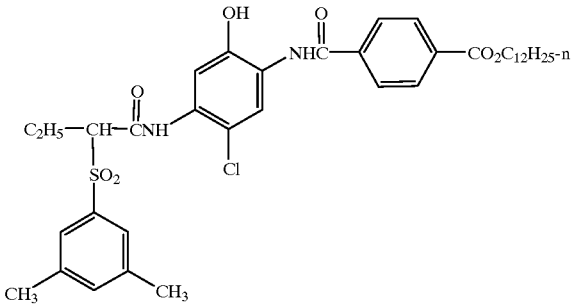
IC-24
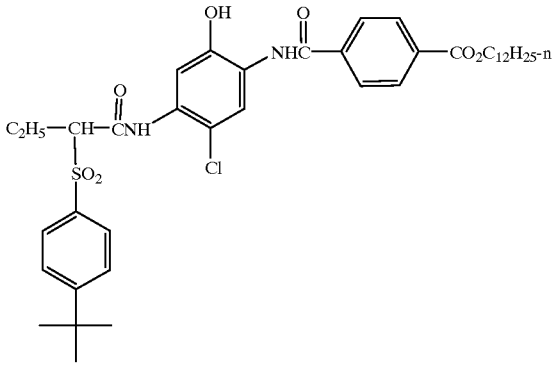
IC-25
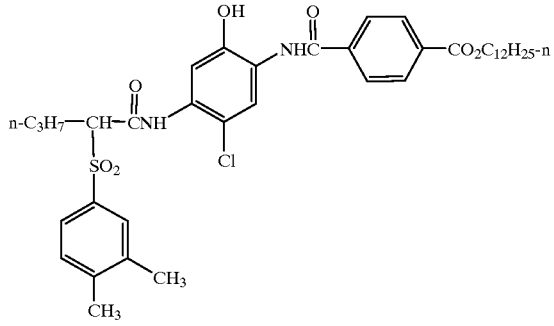

-continued
IC-26
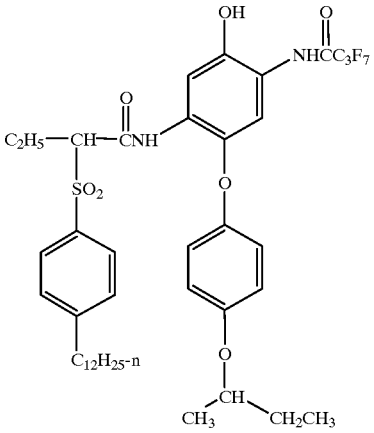
IC-27
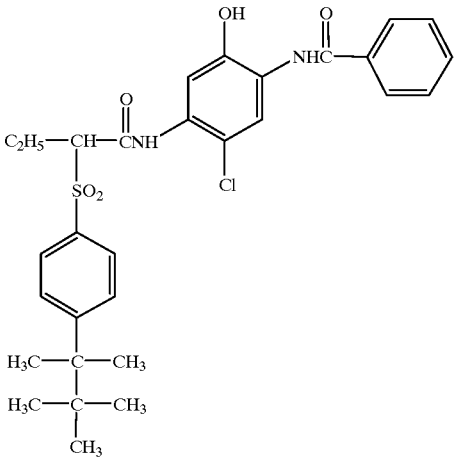
IC-28
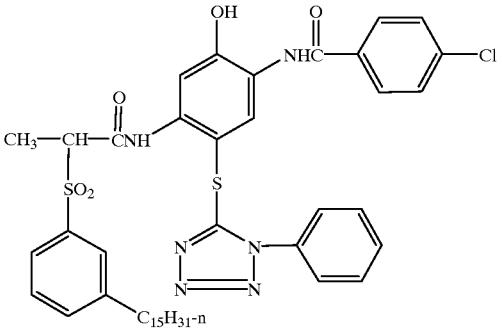
IC-29
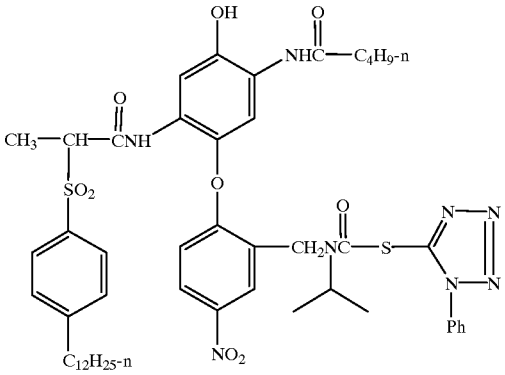
-continued
IC-30
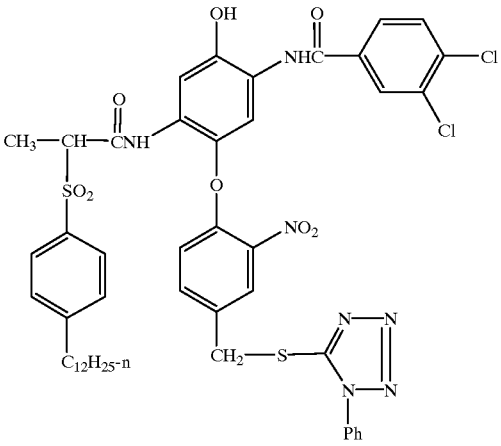
IC-31
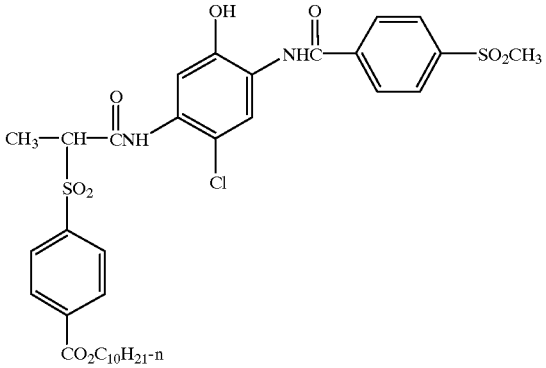
IC-32
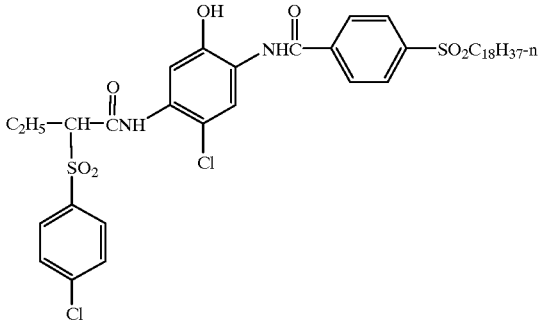
IC-33
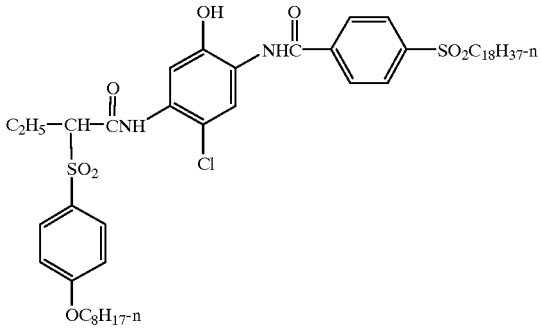

-continued

IC-34

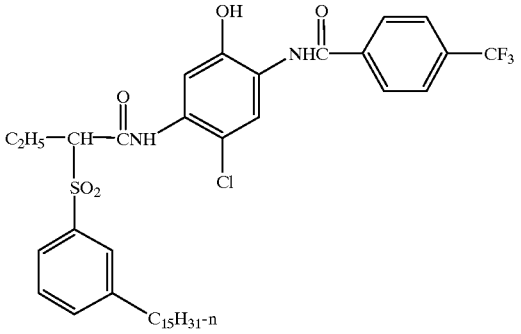

IC-35

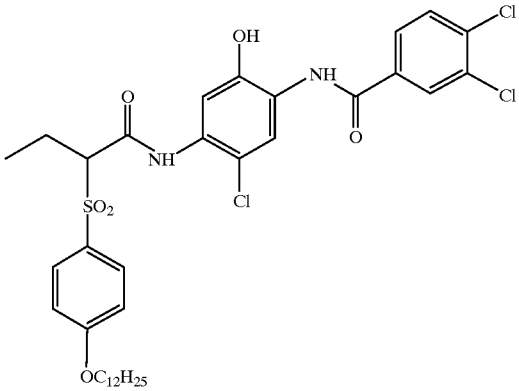

IC-36

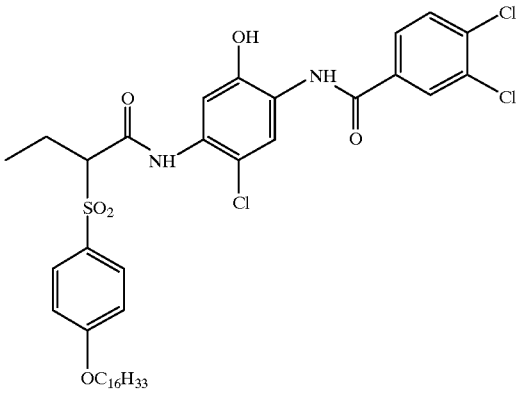

IC-37

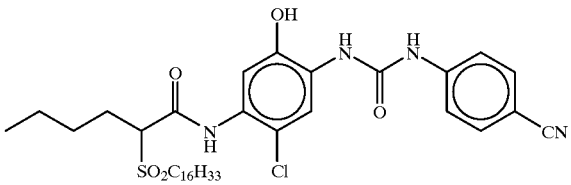

-continued

IC-38

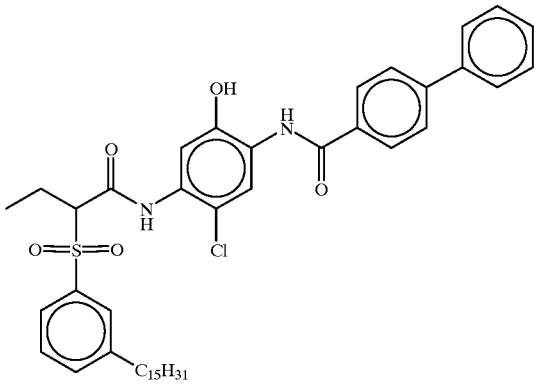

IC-39

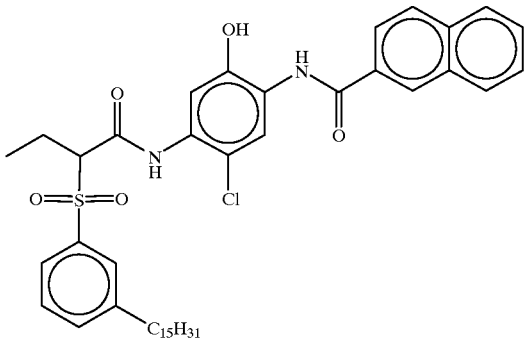

IC-40

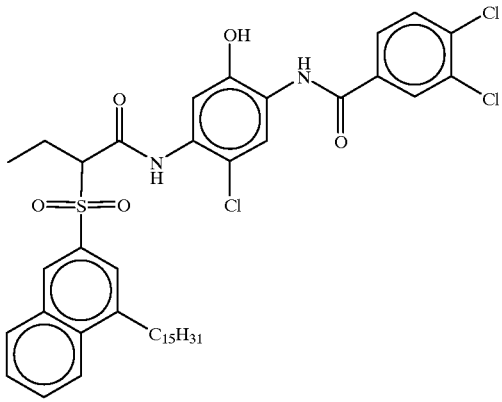

Preferred couplers are IC-3, IC-7, IC-35, and IC-36 because of their suitably narrow left bandwidths.

Couplers that form magenta dyes upon reaction with oxidized color developing agent are described in such representative patents and publications as: U.S. Pat. Nos. 2,311,082; 2,343,703; 2,369,489; 2,600,788; 2,908,573; 3,062,653; 3,152,896; 3,519,429; 3,758,309, and "Farbkupplereine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo[5,1-c]-1,2,4-triazole and 1H-pyrazolo[1,5-b]-1,2,4-triazole. Examples of 1H-pyrazolo[5,1-c]-1,2,4-triazole couplers are described in U.K. Patent Nos. 1,247, 493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Pat. Nos. 4,659,652; 5,066,575; and 5,250,400.

Typical pyrazoloazole and pyrazolone couplers are represented by the following formulas:

MAGENTA-1

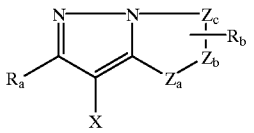

MAGENTA-2

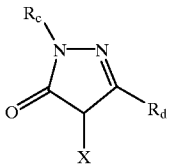

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methane group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$.

Specific examples of such couplers are:

M-1

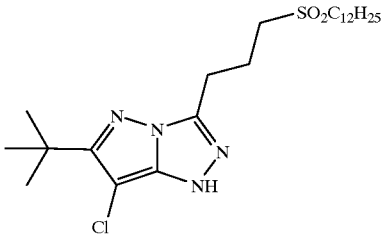

M-2

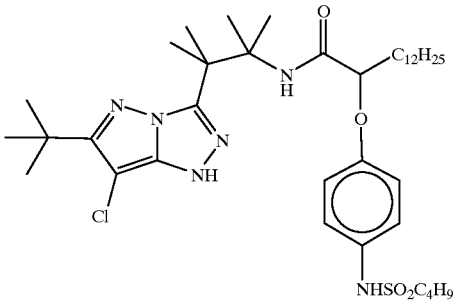

-continued

M-3

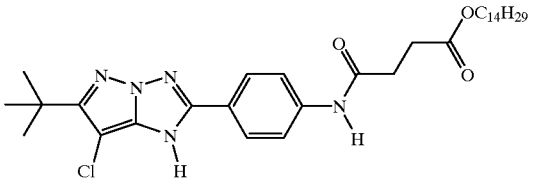

M-4

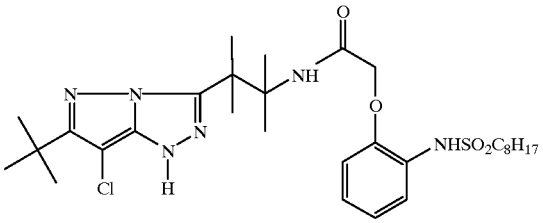

M-5

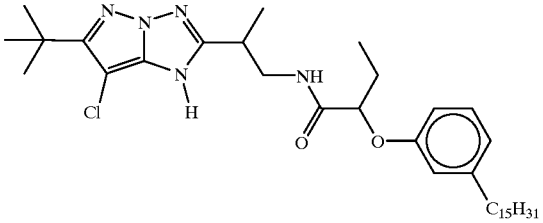

Couplers that form yellow dyes upon reaction with oxidized color developing agent are described in such representative patents and publications as: U.S. Pat. Nos. 2,298,443; 2,407,210; 2,875,057; 3,048,194; 3,265,506; 3,447,928; 3,960,570; 4,022,620; 4,443,536; 4,910,126; and 5,340,703 and "Farbkuppler-eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulas:

YELLOW-1

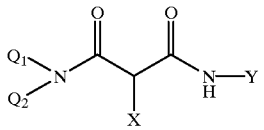

YELLOW-2

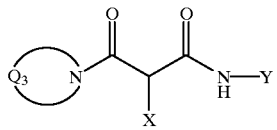

-continued

YELLOW-3

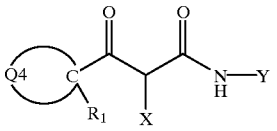

YELLOW-4

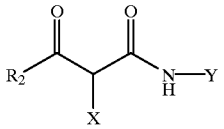

wherein $R_1$, $R_2$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group.

Preferred yellow couplers can be of the following general structures:

Y-1

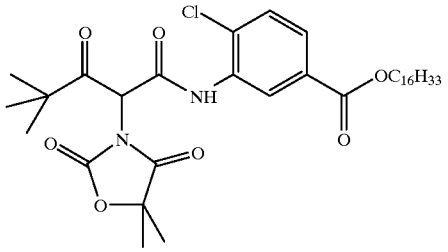

Y-2

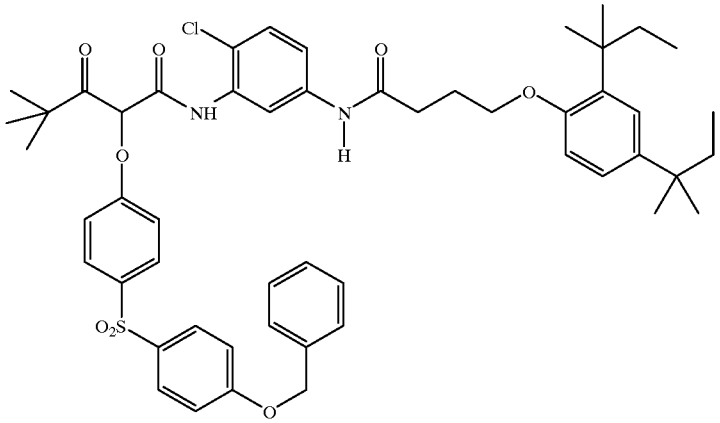

Y-3

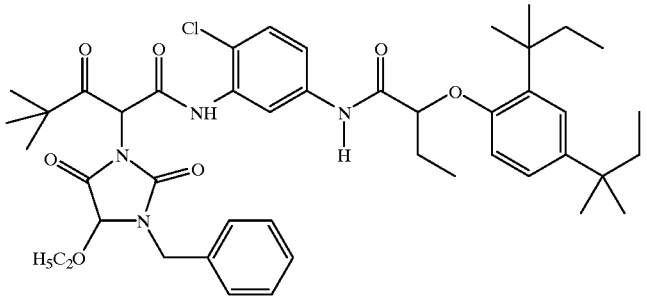

-continued

Y-4

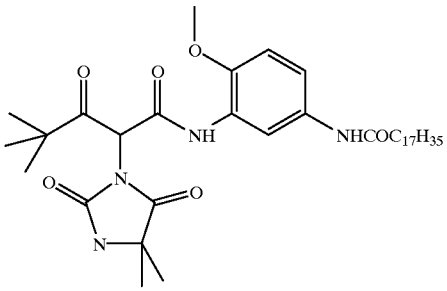

Y-5

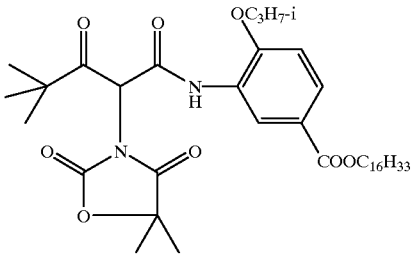

Y-6

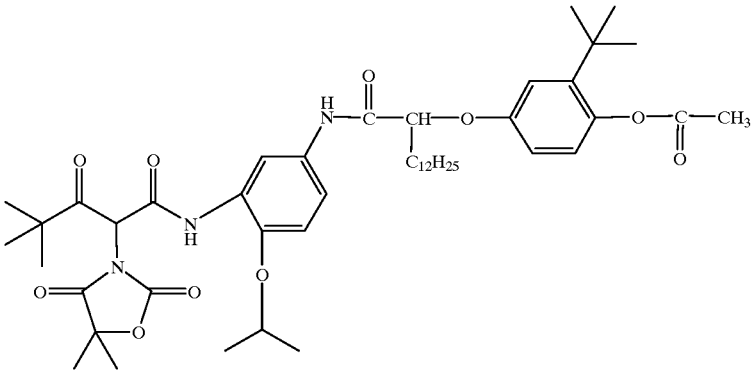

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

Stabilizers and scavengers that can be used in these photographic elements, but are not limited to, the following.

ST-1

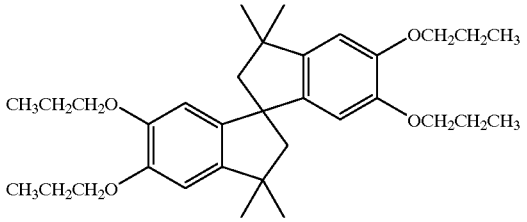

ST-2

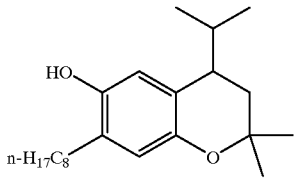

ST-3

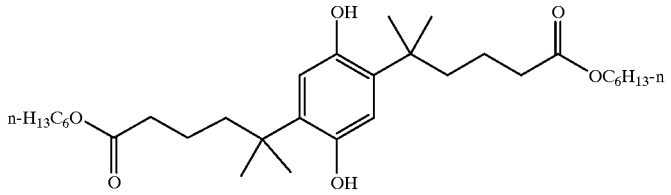

-continued
ST-4
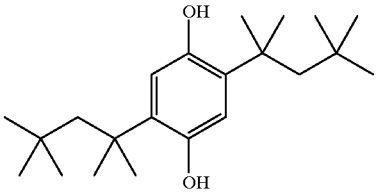
ST-5
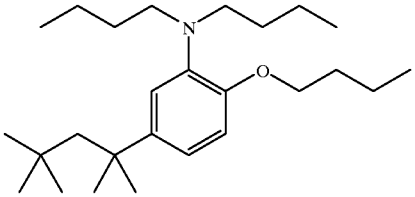
ST-6
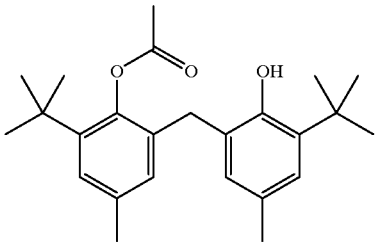
ST-7
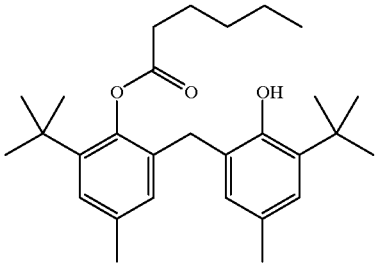
ST-8
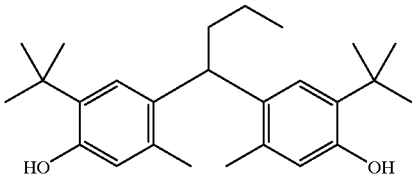
ST-9
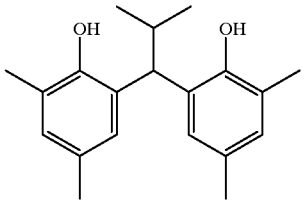

-continued
ST-10
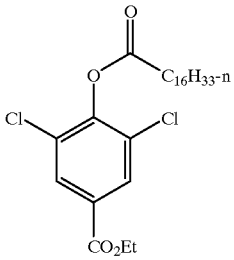
ST-11
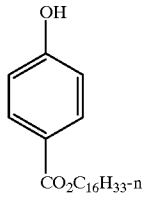
ST-12
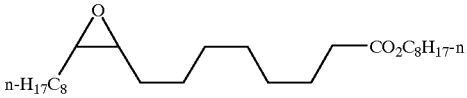
ST-13
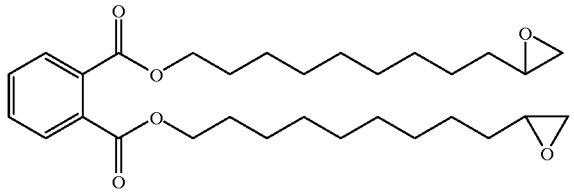
ST-14
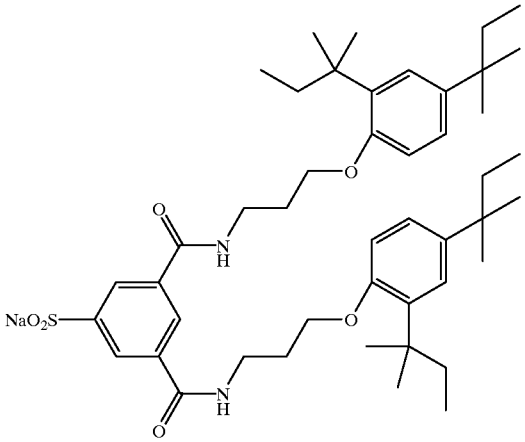
ST-15
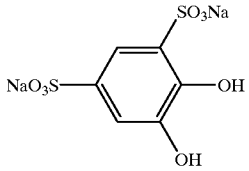
ST-16
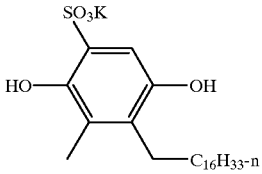

-continued
ST-17
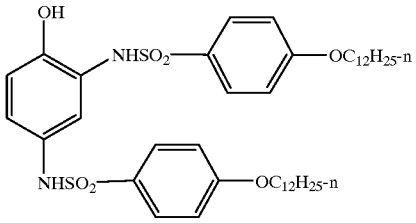
ST-18
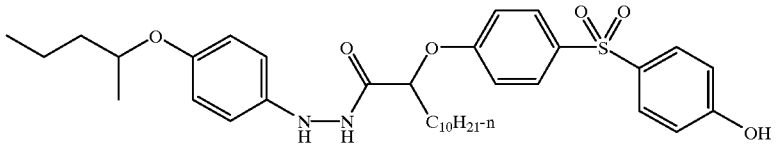
ST-19
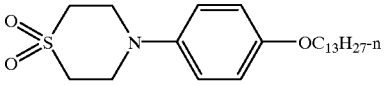
ST-20
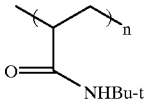
n = 75–8,000
ST-21
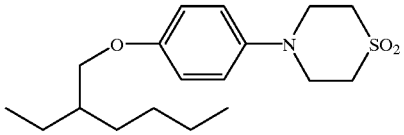
ST-22
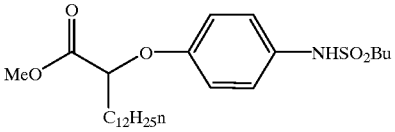
ST-23
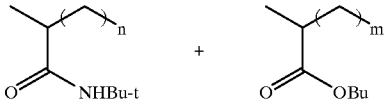
n:m 1:1 mw = 75–100,000
ST-24
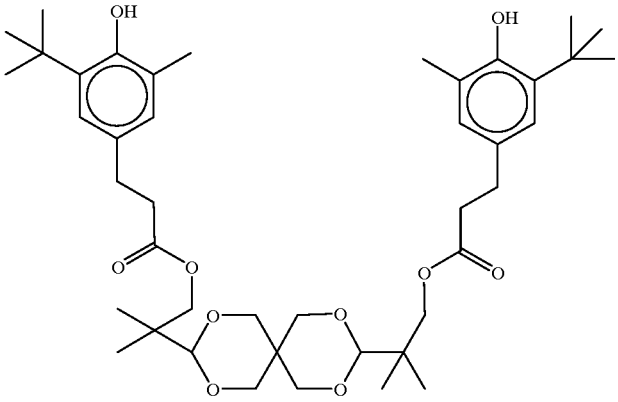

Examples of solvents which may be used in the invention include the following:

| | |
|---|---|
| Tritolyl phosphate | S-1 |
| Dibutyl phthalate | S-2 |
| Diundecyl phthalate | S-3 |
| N,N-Diethyldodecanamide | S-4 |
| N,N-Dibutyldodecanamide | S-5 |
| Tris(2-ethylhexyl)phosphate | S-6 |
| Acetyl tributyl citrate | S-7 |
| 2,4-Di-tert-pentylphenol | S-8 |
| 2-(2-Butoxyethoxy)ethyl acetate | S-9 |
| 1,4-Cyclohexyldimethylene bis(2-ethylhexanoate) | S-10 |

The dispersions used in photographic elements may also include ultraviolet (UV) stabilizers and so called liquid UV stabilizers such as described in U.S. Pat. Nos. 4,992,358; 4,975,360; and 4,587,346. Examples of UV stabilizers are shown below.

UV-1

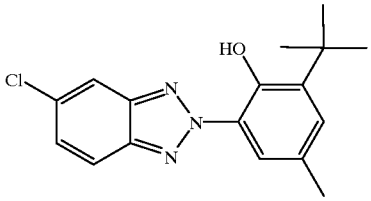

UV-2

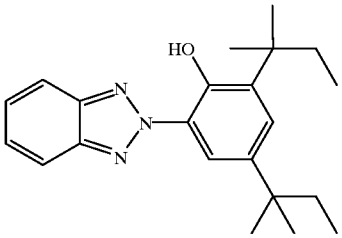

UV-3

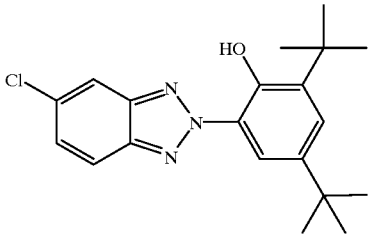

UV-4

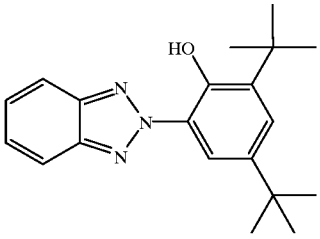

-continued

UV-5

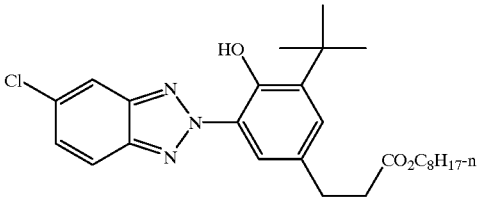

UV-6

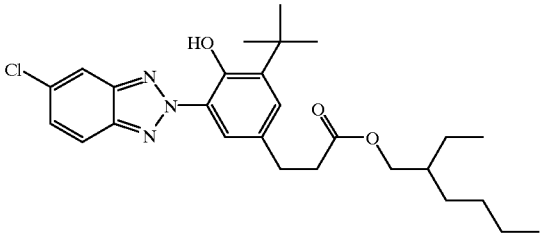

UV-7

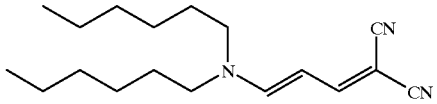

UV-8

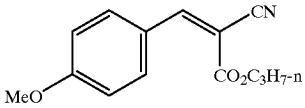

The aqueous phase may include surfactants. Surfactant may be cationic, anionic, zwitterionic or non-ionic. Useful surfactants include, but are not limited to, the following:

SF-1

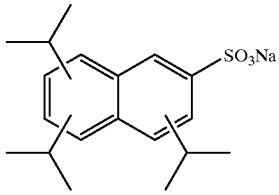

SF-2

$CF_3 \cdot (CF_2)_7 \cdot SO_3Na$

SF-3

$CH_3 \cdot (CH_2)_n \cdot SO_3Na$,
n=12–14

SF-4

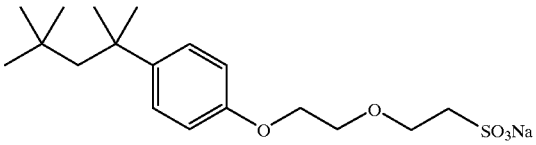

SF-5

$CH_3 \cdot (CH_2)_{11} \cdot OSO_3Na$

SF-6

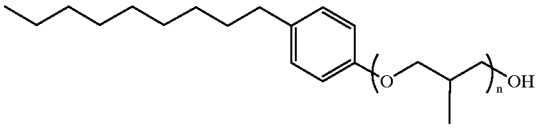

n=ca. 10

-continued

SF-7

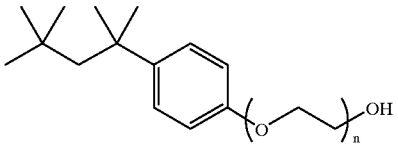

n=ca. 40

SF-8

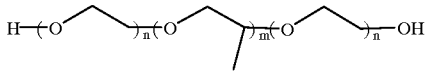

n=ca. 6, m=ca. 2

SF-9

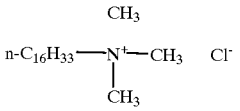

SF-10

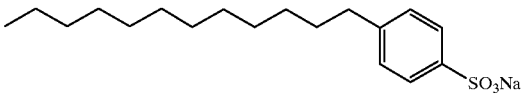

SF-11

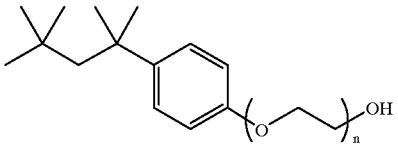

n=ca. 10

SF-12

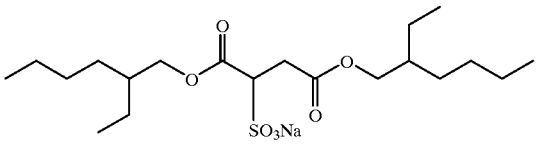

Further, it is contemplated to stabilize photographic dispersions prone to particle growth through the use of hydrophobic, photographically inert compounds such as disclosed by Zengerle et al in U.S. Ser. No. 07/978,104.

In a preferred embodiment the invention employs recording elements which are constructed to contain at least three silver halide emulsion layer units. A suitable full color, multilayer format for a recording element used in the invention is represented by Structure I.

| |
|---|
| Red-sensitized |
| cyan dye image-forming silver halide emulsion unit |
| Interlayer |
| Green-sensitized |
| magenta dye image-forming silver halide emulsion unit |
| Interlayer |
| Blue-sensitized |
| yellow dye image-forming silver halide emulsion unit |
| ///// Support ///// |

Structure I wherein the red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are separated from each other by hydrophilic colloid interlayers containing an oxidized developing agent scavenger to prevent color contamination. Silver halide emulsions satisfying the grain and gelatino-peptizer requirements described above can be present in any one or combination of the emulsion layer units. Additional useful multicolor, multilayer formats for an element of the invention include structures as described in U.S. Pat. No. 5,783,373. Each of such structures in accordance with the invention preferably would contain at least three silver halide emulsions comprised of high chloride grains having at least 50 percent of their surface area bounded by {100} crystal faces and containing dopants from classes (i) and (ii), as described above. Preferably each of the emulsion layer units contains emulsion satisfying these criteria.

Conventional features that can be incorporated into multilayer (and particularly multicolor) recording elements contemplated for use in the method of the invention are illustrated by *Research Disclosure*, Item 38957, cited above:

XI. Layers and layer arrangements

XII. Features applicable only to color negative

XIII. Features applicable only to color positive

B. Color reversal

C. Color positives derived from color negatives

XIV. Scan facilitating features.

The recording elements comprising the radiation sensitive high chloride emulsion layers according to this invention can be conventionally optically printed, or in accordance with a particular embodiment of the invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892. Suitable exposures include those up to 2000 nm, preferably up to 1500 nm. Suitable light emitting diodes and commercially available laser sources are known and commercially available. Imagewise exposures at ambient, elevated or reduced temperatures and/or pressures can be employed within the useful response range of the recording element determined by conventional sensitometric techniques, as illustrated by T. H. James, *The Theory of the Photographic Process,* 4th Ed., Macmillan, 1977, Chapters 4, 6, 17, 18 and 23.

It has been observed that anionic $[MX_xY_yL_z]$ hexacoordination complexes, where M is a group 8 or 9 metal (preferably iron, ruthenium or iridium), X is halide or pseudohalide (preferably Cl, Br or CN) x is 3 to 5, Y is $H_2O$, y is 0 or 1, L is a C—C, H—C or C—N—H organic ligand, and Z is 1 or 2, are surprisingly effective in reducing high intensity reciprocity failure (HIRF), low intensity reciprocity failure (LIRF) and thermal sensitivity variance and in in improving latent image keeping (LIK). As herein employed HIRF is a measure of the variance of photographic properties for equal exposures, but with exposure times ranging from $10^{-1}$ to $10^{-6}$ second. LIRF is a measure of the variance of photographic properties for equal exposures, but with exposure times ranging from $10^{-1}$ to 100 seconds. Although these advantages can be generally compatible with face centered cubic lattice grain structures, the most striking improvements have been observed in high (>50 mole %, preferably ≧90 mole %) chloride emulsions. Preferred C—C, H—C or C—N—H organic ligands are aromatic heterocycles of the type described in U.S. Pat. No. 5,462,849. The most effective C—C, H—C or C—N—H organic ligands are azoles and azines, either unsustituted or containing alkyl, alkoxy or halide substituents, where the alkyl moieties contain from 1 to 8 carbon atoms. Particularly preferred azoles and azines include thiazoles, thiazolines and pyrazines.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^2$ ergs/cm $^2$. Exposure of the recording element in a pixel-by-pixel mode as known in the prior art persists for only a very short duration or time. Typical maximum exposure times are up to 100$\mu$ seconds, often up to 10$\mu$ seconds, and frequently up to only 0.5$\mu$ seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1.

Once imagewise exposed, the recording elements can be processed in any convenient conventional manner to obtain a viewable image. Such processing is illustrated by *Research Disclosure*, Item 38957, cited above:

| | |
|---|---|
| XVIII. | Chemical development systems |
| XIX. | Development |
| XX. | Desilvering, washing, rinsing and stabilizing |

In addition, a useful developer for the inventive material is a homogeneous, single part developing agent. The homogeneous, single-part color developing concentrate is prepared using a critical sequence of steps:

In the first step, an aqueous solution of a suitable color developing agent is prepared. This color developing agent is generally in the form of a sulfate salt. Other components of the solution can include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent. This solvent is present in the final concentrate at a concentration such that the weight ratio of water to the organic solvent is from about 15:85 to about 50:50.

In this environment, especially at high alkalinity, alkali metal ions and sulfate ions form a sulfate salt that is precipitated in the presence of the hydroxy-containing organic solvent. The precipitated sulfate salt can then be readily removed using any suitable liquid/solid phase separation technique (including filtration, centrifugation or decantation). If the antioxidant is a liquid organic compound, two phases may be formed and the precipitate may be removed by discarding the aqueous phase.

The color developing concentrates of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921 A1 (published Mar. 10, 1993). It may be useful for the color developing agents to have one or more water-solubilizing groups as are known in the art. Further details of such materials are provided in *Research Disclosure*, publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones. Mixtures of compounds from the same or different classes of antioxidants can also be used if desired.

Especially useful antioxidants are hydroxylamine derivatives as described, for example, in U.S. Pat. No. 4,892,804, U.S. Pat. No. 4,876,174, U.S. Pat. No. 5,354,646, and U.S. Pat. No. 5,660,974, all noted above, and U.S. Pat. No. 5,646,327 (Burns et al). Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference, as having the structure I:

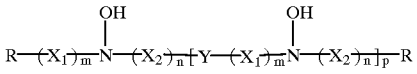

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CHR_1$- and $X_2$ is —$CHR_1CR_2(OH)$— wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

The following examples illustrate the practice of this invention. They are not intended to be exhaustive of all possible variations of the invention. Parts and percentages are by weight unless otherwise indicated.

EXAMPLES

Example 1

In this example two iterations of the invention (sample 1 and 2) utilizing a polyester binder layer are compared to a typical polyethylene melt cast imaging support (sample 4) and a imaging support consisting of biaxially oriented polyolefin sheets laminated to paper utilizing a ethylene based binder layer (sample 3). This example will show that the invention support materials are superior to prior art imaging support materials for tear resistance. Further, it will be obvious that the invention materials are also superior for image whiteness and opacity.

Photographic Grade Cellulose Paper Used in the Example

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26 anionic polyacrylamide, and 5.0% $TiO_2$ on a dry weight basis. An about 147 g/m$^2$ bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

Sample 1 (Invention)

Sample 1 was constructed by melt extrusion laminating imaging grade biaxially oriented polyolefin sheets to the base paper of the example. The binder layer utilized was a melt extrusion grade polyester. An extrusion coating grade copolyester (Eastman 9921) was extrusion coated as the tie layer. The resin has an intrinsic viscosity of 0.8 and a crystalline density of approximately 1.4 g/cm$^3$. The melting point is 250° C. and has a tensile modulus of 2300 MPa and a breaking strength of 45 MPa.

The support structure for sample 1 is listed below:

L1: Low density polyethylene
L2: Polypropylene with 24% anatase $TiO_2$ and optical brightener
L3: Voided polypropylene with a density of 0.84 g/cc
L4: Polypropylene with 18% rutile $TiO_2$
L5: Binder layer consisting of a extrusion grade polyester
L6: Imaging grade cellulose base paper
L7: Binder layer consisting of a extrusion grade polyester
L8: Polyester with a skin of a copolymer of polyethylene and a terpolymer of ethylene propylene and butylene
L9: Styrene butadiene methacrylate coating Sample 2 (Invention)

Sample 2 was constructed by melt extrusion laminating imaging grade biaxially oriented polyolefin sheets to the base paper of the example. The binder layer utilized was a blend of melt extrusion grade polyester and an anhydride modified ethylene acrylate (DuPont Bynel 2174). An extrusion coating grade copolyester (Eastman 9921) was extrusion coated as the binder layer. The resin has an intrinsic viscosity of 0.8 and a crystalline density of approximately 1.4 g/cm$^3$ as measured by ASTM D 1505. The melting point is 250° C. and has a tensile modulus of 2,300 MPa and a breaking strength of 45 MPa. This compares to low density polyethylene which has a tensile modulus of 170 MPa and a breaking strength of 24 MPa.

The imaging support structure for sample 2 is listed below:

L1: Low density polyethylene
L2: Polypropylene with 24% anatase $TiO_2$ and optical brightener
L3: Voided polypropylene with a density of 0.84 g/cc
L4: Polypropylene with 18% rutile $TiO_2$
L5: L1: Low density polyethylene
L2: Polypropylene with 24% anatase $TiO_2$ and optical brightener
L3: Voided polypropylene with a density of 0.84 g/cc
L4: Polypropylene with 18% rutile $TiO_2$
L5: Binder layer consisting of a extrusion grade polyester and an anhydride modified ethylene acrylate
L6: Imaging grade cellulose base paper
L7: Binder layer consisting of a extrusion grade polyester an anhydride modified ethylene acrylate
L8: Polyester with a skin of a copolymer of polyethylene and a terpolymer of ethylene propylene and butylene
L9: Styrene butadiene methacrylate coating

Example 3 (Control)

Commercially available Eastman Kodak Ektatherm XLS Thermal dye transfer reflective receiver. This imaging support materials has a paper base laminated on the top and bottom sides with biaxially oriented polyolefin sheets.

Example 4 (Control)

Typical color photographic paper consisting of a two side polyethylene melt cast coating on a photographic grade paper base.

Tear resistance for the imaging supports elements is the amount of force required to start a tear along an edge of the photographic element. The tear resistance test used was originally proposed by G. G. Gray and K. G. Dash, Tappi Journal 57, pages 167–170 published 1974. The tear resistance for the photographic elements is determined by the tensile strength and the stretch of the photographic element. A 15 mm×25 mm sample is looped around a metal cylinder with a 2.5 cm diameter. The two ends of the sample are clamped by a Instron tensile tester. A load is applied to the sample at a rate of 2.5 cm per minute until a tear is observed at which time the load expressed in N, is recorded. The tear resistance was measured for the four samples (samples 1–4) of this example. The tear resistance mean values are listed in Table 1 below:

TABLE 1

| Sample | Tear Resistance (N) |
|---|---|
| 1 (invention) | 913 |
| 2 (invention) | 878 |
| 3 (control) | 675 |
| 4 (control) | 135 |

The results above clearly demonstrate that the use of a polyester binder layer (samples 1 and 2) improves the tear resistance of a imaging support material consisting of biaxially oriented polyolefin sheets laminated to cellulose paper compared to the imaging support that utilized an ethylene based binder layer (sample 3). The invention also had significantly higher tear resistance than typical polyethylene cast coated photographic support materials. Tear resistant support materials are perceptually preferred in that they offer the consumer image durability as images are viewed, displayed and stored. The improvement in tear resistance of imaging support materials of the invention also improves the web transport efficiency and picking efficiency of digital printing equipment such as an ink jet printers or a thermal dye transfer printers. Additionally, because higher weight percent loading of $TiO_2$ can be utilized in the invention, the support material would result in a brighter, whiter, sharper image with improved image opacity. Finally, because the tough binder layers utilized in the invention have a lower energy to break than melt extruded ethylene based materials, the invention would punch, chop and slit more efficiently than prior art bonding layers.

The invention has been described in detail with particular reference to certain preferred embodiments thereof, but it will be understood that variations and modifications can be effected within the spirit and scope of the invention.

What is claimed is:

1. An imaging member comprising a substrate, at least one oriented polymer sheet adhered to said substrate and a binder layer between said at least one oriented polymer sheet and said substrate, wherein said binder layer comprises a binder polymer that has an energy to break of between $9.0\times10^5$ J/m$^3$ and $3.5\times10^7$ J/m$^3$ and said binder polymer comprises a polyester polymer.

2. The imaging member of claim 1 wherein said binder polymer comprises at least one white pigment.

3. The imaging member of claim 1 wherein said binder polymer comprises a hindered amine light stabilizer.

4. The imaging member of claim 1 wherein said oriented polymer sheet comprises a polymer sheet having a Young's modulus of less than 3,500 MPa.

5. The imaging member of claim 1 wherein said oriented polymer sheet comprises a biaxially oriented polyolefin sheet.

6. The imaging member of claim 5 wherein said biaxially oriented polyolefin sheet comprises at least one layer having voids.

7. The imaging member of claim 1 further comprising at least one layer comprising photosensitive silver halide.

8. The imaging member of claim 1 further comprising at least one layer comprising an ink jet or thermal dye receiving layer.

9. The imaging member of claim 1 wherein said substrate comprises cellulose fiber paper.

10. The imaging member of claim 1 wherein said substrate comprises a voided polyester sheet.

11. The imaging member of claim 1 wherein said substrate has a Young's modulus of less than 18,000 MPa.

12. The imaging member of claim 1 wherein said imaging member has a Young's modulus of between 2,000 MPa and 30,000 MPa.

13. The imaging member of claim 1 wherein said imaging member has a tear strength of between 800 and 24,000 Newtons.

14. The imaging member of claim 1 wherein said substrate has an oriented polymer sheet adhered to both sides.

15. The imaging member of claim 14 wherein both of the oriented polymer sheets are adhered with a binder polymer having an energy to break of between $9.0\times10^5$ J/m$^3$ and $3.5\times10^7$ J/m$^3$.

16. The imaging member of claim 1 wherein said binder layer comprises two or more integral layers of polymer.

17. The imaging member of claim 1 wherein said oriented sheet further comprises an adhesion promoting layer.

18. The imaging member of claim 1 wherein said binder polymer has a tensile modulus of between 1,500 to 3,300 MPa and a breaking strength of between 35 to 65 MPa.

19. The imaging member of claim 15 wherein said substrate comprises cellulose fiber paper.

20. An imaging member comprising a polyester sheet substrate, at least one oriented polymer sheet adhered to said substrate and a binder layer between said at least one oriented polymer sheet and said substrate, wherein said binder layer comprises a binder polymer that has an energy to break of between $9.0\times10^5$ J/m$^3$ and $3.5\times10^7$ J/m$^3$.

21. The imaging member of claim 20 wherein said binder polymer comprises a polyester polymer.

22. The imaging member of claim 20 wherein said binder polymer comprises a polypropylene polymer.

23. The imaging member of claim 20 wherein said binder polymer is selected from the group consisting of polyesters, polyamides and polypropylene and their copolymer derivatives.

24. The imaging member of claim 20 wherein said binder polymer comprises a blend of polyolefin adhesives and polymer that has a energy to break of between $9.0\times10^5$ J/m$^3$ and $3.5\times10^7$ J/m$^3$.

25. The imaging member of claim 20 wherein said binder polymer comprises at least one white pigment.

26. The imaging member of claim 20 wherein said oriented polymer sheet comprises a biaxially oriented polyolefin sheet.

27. The imaging member of claim 20 further comprising at least one layer comprising photosensitive silver halide.

28. The imaging member of claim 20 further comprising at least one layer comprising an ink jet or thermal dye receiving layer.

29. The imaging member of claim 26 wherein said imaging member has a Young's modulus of between 2,000 MPa and 30,000 MPa.

30. The imaging member of claim 20 wherein said substrate comprises a voided polyester sheet.

31. The imaging member of claim 20 wherein said imaging member has a tear strength of between 800 and 24,000 Newtons.

32. The imaging member of claim 20 wherein said substrate has an oriented polymer sheet adhered to both sides.

33. The imaging member of claim 32 wherein only one of the oriented polymer sheets is adhered with a binder polymer having an energy to break of between $9.0\times10^5$ J/m$^3$ and $3.5\times10^7$ J/m$^3$.

34. The imaging member of claim 32 wherein both of the oriented polymer sheets are adhered with a binder polymer having an energy to break of between $9.0\times10^5$ J/m$^3$ and $3.5\times10^7$ J/m$^3$.

35. The imaging element of claim 20 wherein said binder layer comprises two or more integral layers of polymer.

36. The element of claim 20 wherein said binder polymer has a tensile modulus of between 1,500 to 3,300 MPa and a breaking strength of between 35 to 65 MPa.

37. An imaging member comprising a substrate, at least one oriented polymer sheet adhered to said substrate and a binder layer between said at least one oriented polymer sheet and said substrate, wherein said binder layer comprises a binder polymer that has an energy to break of between $9.0\times10^5$ J/m$^3$ and $3.5\times10^7$ J/m$^3$, said substrate has an oriented polymer sheet adhered to both sides, and only one of the oriented polymer sheets is adhered with a binder polymer having an energy to break of between $9.0\times10^5$ J/m$^3$ and $3.5\times10^7$ J/m$^3$.

38. The imaging member of claim 37 wherein said binder polymer comprises a polyester polymer.

39. The imaging member of claim 37 wherein said binder polymer comprises a polypropylene polymer.

40. The imaging member of claim 37 wherein said binder polymer is selected from the group consisting of polyesters, polyamides and polypropylene and their copolymer derivatives.

41. The imaging member of claim 37 wherein said oriented polymer sheet comprises a polymer sheet having a Young's modulus of less than 3,500 MPa.

42. The imaging member of claim 40 wherein said oriented polymer sheet comprises a biaxially oriented polyolefin sheet.

43. The imaging member of claim 42 further comprising at least one layer comprising photosensitive silver halide.

44. The imaging member of claim 43 wherein said substrate comprises cellulose fiber paper.

45. The imaging member of claim 37 wherein said imaging member has a tear strength of between 800 and 24,000 Newtons.

46. The imaging element of claim 37 wherein said binder layer comprises two or more integral layers of polymer.

* * * * *